US005283387A

United States Patent [19]

Tanaka

[11] Patent Number: 5,283,387

[45] Date of Patent: Feb. 1, 1994

[54] MUSICAL SOUND GENERATOR WITH SINGLE SIGNAL PROCESSING MEANS

[75] Inventor: Kikuji Tanaka, Fussa, Japan

[73] Assignee: Casio Computer Co., Ltd., Tokyo, Japan

[21] Appl. No.: 790,785

[22] Filed: Nov. 12, 1991

[30] Foreign Application Priority Data

Nov. 20, 1990 [JP] Japan ..... 2-315245
Nov. 20, 1990 [JP] Japan ..... 2-315245
Nov. 20, 1990 [JP] Japan ..... 2-315246

[51] Int. Cl.[5] ..... G10H 1/12; G10H 7/10

[52] U.S. Cl. ..... 84/608; 84/604; 84/615; 84/661

[58] Field of Search ..... 84/602, 604, 608, 615, 84/623, 624, 627, 647, 648, 708, 661, 663; 381/61

[56] References Cited

U.S. PATENT DOCUMENTS 4,130,043 12/1978 Niimi ..... 84/103
4,437,377 3/1984 Mitarai et al. ..... 84/647
4,554,857 11/1987 Nishimoto ..... 84/624
4,677,789 7/1987 Yannes ..... 84/661
4,736,333 4/1988 Mead et al. ..... 364/736
4,736,663 4/1988 Wawarzynek et al. ..... 84/627
4,840,099 6/1989 Kitagawa ..... 84/627
4,933,980 6/1990 Thompson ..... 381/61
4,998,281 3/1991 Sakata ..... 381/63
5,099,739 3/1992 Adachi ..... 84/604
5,111,530 5/1992 Kutaragi et al. ..... 84/708
5,144,676 9/1992 Rossum ..... 84/603

*Primary Examiner*—William M. Shoop, Jr.
*Assistant Examiner*—Jeffrey W. Donels
*Attorney, Agent, or Firm*—Frishauf, Holtz, Goodman & Woodward

[57] ABSTRACT

A single signal processor performs a pitch process which produces musical sound waveform data having a frequency corresponding to received pitch data, a filtering process for filtering the generated musical sound waveform data, and an amplitude process which controls the amplitude of a musical sound generated on the basis of the filtered musical sound waveform data in order to produce a musical sound. It simultaneously performs outputting the produced musical sound waveform data to a plurality of output terminals and an effect process which imparts an effect to the musical sound data. The signal processor outputs at least one of musical sound waveform data to which the effect is imparted and musical sound waveform data to which no effects are imparted, using at least one of an external and an internal effect circuit to thereby impart a variety of effects to the resulting musical sound.

51 Claims, 32 Drawing Sheets

C-RAM
L-RAM
R-RAM
CMP
RG
SEL
CPU
EXP dB
Clip
Sel
AEND
CMP
WA
WW-RAM
HA
DD1
DD2
SH x 4
SH 1/2
SH x 8
EXP
F-RAM PT,WE
W-RAM WL
V-RAM LV,RV, GV,FV
MEMORY WRITE DATA
WAVE ROM
ADS RG
DACK
DNCK
CPCK
ADDRESS
DATA1
DATA2
FRACTION
Lch OUTPUT
Rch OUTPUT
SH
GO
GV
AC
FO
PC
PT
ERO
WL
WRo
VRo
DN
DP
BC
CK
Eo
K
LV
RV
AL
AR
AL'
AR'
FA
WA
VA
200
400
500
600
700
800
900
300
103

FIG. 5

| CH | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| CY | 0 | | | | | | | | | | | | | | | |
| FF-RAM | readDD1o | readDD2o | readFDo | readGoo | | readDD2o | | readDD1o | writeDD1o | | | | write | | | writeFoo |
| FFR | | DD1o | DD 2o | FOo | Goo | PTo | DD2o | | DD1o | | | | GOo | | | |
| YL | | | | | Goo | | | | | | | | | | | |
| WW-RAM | | readWAo | | ADDRESS | | | | | | readWAo | | readWAo | | | write | |
| WWR | | | WAo | | | | | | | | WAo | WLo | WAo | | WAo | |
| VVR | | | | LVo | RVo | | | | | GVo | | | | FVo | | |
| Eo | | BCo | CCo | | | PCo | | | ACo | | | | | | | |
| DN | | | | | | | DNo | | | | | | | | | |
| DP | | | | | | | | | | DPo | | | | | | |
| MO | | FFR | FFR | FFR | ER | FR | | | ER | ER | ER | MR | WWR | | ER | |
| MI | | EO | EO | JR | YL | YL | | | TR | TR | SR | JR | JR | | JR | |
| MR | | | F1 | F2 | F4 | 03 | 04 | | | P5 | A5 | A2 | GO | D2 | | FO |
| JO | | | EO | MR | MR | EO | SR | | SR | MR | MR | DP | | MR | | |
| JI | | | XR | XR | JR | FFR | FFR | | FFR | XR | XR | DN | | DN | | |
| JR | | | | K | F3 | F5 | P1 | F7 | | F9 | P6 | A6 | D1 | | D3 | |
| KO | | | | | | AO | AO | | | | WWR | | | AO | AO(W) | |
| KI | | | | | | MR | MR | | | | JR | | | XR | | |
| KR | | | | | | | 03 | 04 | | | | P7 | | | P8 | |
| KL | | | | | | | | | | | | P7 | | | | |
| AL | | | | | | | 03 | | | | | | | | | |
| AR | | | | | | | | 04 | | | | | | | | |
| AO | | | AL | AR | | AL | AR | | | | | | | KL | KRorKL | |
| So | | | Ao | Ao | | JR | JR | JR | XR(W) | JR | | | MR(W) | | | FO(W) |
| SR | | | | AL' | AR' | | F6 | P2 | F8 | | F10 | | | | | |
| | | | Lch OUTPUT | | Rch OUTPUT | | | | | | | | | | | |
| EO | | | | VVR | VVR | | | SR | EO | VVR | | | | VVR | | |
| ER | | | | | e1 | 02 | | | P3 | A3 | A1 | | | | D4 | |
| TR | | | | | | | | | P4 | A4 | | | | | | |
| Xo | | (Eo+0.25) | MR | | | | SR | | ER | ER | | WWR | | | | |
| XR | | | F0 | F1 | | | | F6 | | P3 | A3 | | WL | | | |

$$K=(B+C+1)/4 = \underline{BC}+CC+\underline{0.25}$$

FIG.29

| CH | 0 | | | | | | | | | | | | | | |
|---|---|---|---|---|---|---|---|---|---|---|---|---|---|---|---|
| CY | 0 | 1 | 2 | 3 | 4 | 5 | 6 | 7 | 8 | 9 | A | B | C | D | E | F |
| FF-RAM | readDD1o | readDD2o | readFDo | readGoo | | readDD2o | | readDD1o | writeDD1o | | | | write | | | writeFoo |
| FFR | | DD1o | DD2o | FOo | Goo | PTo | DD2o | | DD1o | | | | GOo | | | |
| | | | | | Goo | | | | | | | | | | | |
| YL | | | | | | | | | | | | | | | | |
| WW-RAM | | readWAo | | ADDRESS | | | | | | readWAo | | readWAo | | | write | |
| WWR | | | WAo | | | | | | | | WAo | WLo | WAo | | WAo | |
| VVR | | | | LVo | RVo | EVo | | | | GVo | | | | FVo | | |
| Eo | | BCo | CCo | | | PCo | | | ACo | | | | | | | ECo |
| Ro | Ro2F | | | | | | | | | | | | | | | ROIO |
| DN | | | | | | | DNo | | | | | | | | | |
| DP | | | | | | | | | | DPo | | | | | | |
| MO | ER | FFR | FFR | FFR | ER | FR | ER | | ER | ER | ER | MR | WWR | | ER | BL |
| MI | Ro | EO | EO | JR | YL | YL | YL | | TR | TR | SR | JR | JR | | JR | Ro |
| MR | RMPY(F) | V2(F) | F1 | F2 | F4 | 03 | 04 | 06 | | P5 | A5 | A2 | GO | D2 | | FO |
| JO | | | EO | MR | MR | EO | SR | | SR | MR | MR | DP | | MR | | |
| JI | | | XR | XR | JR | FFR | FFR | | FFR | XR | XR | DN | | DN | | |
| JR | | | | K | F3 | F5 | P1 | F7 | | F9 | P6 | A6 | D1 | | D3 | |
| KO | | | | | | AO | AO | Ao | | | WWR | | | AO | AO(W) | |
| KI | | | | | | MR | MR | MR | | | JR | | | XR | | |
| KR | | | | | | | 03 | 04 | 06 | | | P7 | | | P8 | |
| KL | | | | | | | | | | | | P7 | | | | |
| AL | | | | | | | 03 | | | | | | | | | |
| AR | | | | | | | | 04 | | | | | | | | |
| AO | | | AL | AR | AE | AL | AR | AE | | | | | | KL | KRorKL | |
| AE | | | Ao | Ao | Ao | JR | JR | JR | 06 | | | | MR(W) | | | FO(W) |
| So | | | | AL' | AR' | AE' | F6 | P2 | XR(W) | JR | | | | | | |
| SR | | | | | | | | | F8 | | F10 | | | | | |
| | | | Lch OUTPUT | | Rch OUTPUT | | | | | | | | | | | |
| EO | | | | VVR | VVR | VVR | | SR | EO | VVR | | | | VVR | | Eo |
| ER | V1(F) | | | | 0 1 | 02 | 05 | | P3 | A3 | A1 | | | | D4 | |
| TR | | | | | | | | | P4 | A4 | | | | | | |
| Xo | | (Eo+0.25) | MR | | | | SR | | ER | ER | | WWR | | | | |
| XR | | | F0 | F1 | | | | F6 | | P3 | A3 | | WL | | | |

FIG. 37

| CH | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| CY | 0 | | | | | | | | | | | | | | | |
| FF-RAM | readDD1o | readDD2o | readFDo | readGoo | | readDD2o | | readDD1o | writeDD1o | | | | write | | | writeFoo |
| FFR | | DD1o | DD2o | FOo | Goo | PTo | DD2o | | DDIo | | | | GOo | | | |
| YL | | | | | Goo | | | | | | | | | | | |
| WW-RAM | | readWAo | | ADDRESS | | | | | | readWAo | | readWAo | | | write | |
| WWR | | | WAo | | | | | | | | WAo | WLo | WAo | | WAo | |
| VVR | | | | LVo | RVo | EVo | TVo | | | GVo | | | | FVo | | |
| Eo | | BCo | CCo | | | PCo | | | ACo | | | | | | | ECo |
| Ro | Ro2F | | | | | | | | | | | | | | | ROIO |
| DN | | | | | | | DNo | | | | | | | | | |
| DP | | | | | | | | | | DPo | | | | | | |
| MO | ER | FFR | FFR | FFR | ER | FR | ER | | ER | ER | ER | MR | WWR | | ER | BL |
| MI | Ro | EO | EO | JR | YL | YL | YL | | TR | TR | SR | JR | JR | | JR | Ro |
| MR | RMPY (F) | V2(F) | F1 | F2 | F4 | 03 | 04 | 06 | 08 | P5 | A5 | A2 | GO | D2 | | FO |
| JO | | | EO | MR | MR | EO | SR | | SR | MR | MR | DP | | MR | | |
| JI | | | XR | XR | JR | FFR | FFR | | FFR | XR | XR | DN | | DN | | |
| JR | | | | K | F3 | F5 | P1 | F7 | | F9 | P6 | A6 | D1 | | D3 | |
| KO | | | | | | AO | AO | Ao | | | WWR | | | AO | AO(W) | |
| KI | | | | | | MR | MR | MR | | | JR | | | XR | | |
| KR | | | | | | | 03 | 04 | 06 | 08 | | P7 | | | P8 | |
| KL | | | | | | | | | | | | P7 | | | | |
| AL | | | | | | | 03 | | | | | | | | | |
| AR | | | | | | | | 04 | | | | | | | | |
| AO | | AE | AL | AR | AE | AL | AR | AE | 06 | 08 | | | | KL | KRorKL | |
| AE | | Ao | Ao | Ao | Ao | JR | JR | JR | XR(W) | JR | | | MR(W) | | | FO(W) |
| AT | | | AE | AL' | AR' | AT' | F6 | P2 | F8 | | F10 | | | | | |
| So | | | | | | | | | | | | | | | | |
| SR | | Lch OUTPUT | | | Rch OUTPUT | | | | | | | | | | | |
| EO | | | | VVR | VVR | VVR | | SR | EO | VVR | | | | VVR | | Eo |
| ER | V1(F) | | | | C1 | 02 | 05 | 07 | P3 | A3 | A1 | | | | D4 | |
| TR | | | | | | | | | P4 | A4 | | | | | | |
| Xo | | (Eo+0.25) | MR | | | | SR | | ER | ER | | WWR | | | | |
| XR | | | F0 | F1 | | | | F6 | | P3 | A3 | | WL | | | |

MUSICAL SOUND GENERATOR WITH SINGLE SIGNAL PROCESSING MEANS

BACKGROUND OF THE INVENTION

1. Field of the Invention

The present invention relates to musical sound generators used in electronic musical instruments, and more particularly to a musical sound generator which realizes a plurality of musical sound processing operations for the generation of a musical sound, using a single IC.

2. Description of the Related Art

Recently, generation of a musical sound which requires processing a large amount of data at high speed is performed by dedicated hardware called a sound source device. In the hard ware, a microcomputer processes control inputs (inputs from a keyboard and/or a console panel external control inputs such as MIDI, inputs from internal or external play memories, etc.,) to the musical instrument and transfers commands suitable for the sound source device to same.

As the number of required functions increases in the conventional musical sound generator, the number of operations and/or calculations also increases. As a result, a generalized method is to cause a plurality of LSIs to serve the corresponding functions to thereby achieve a desired synthetic function.

Recently, a sound source device itself is required to have various functions such as filtering musical sound waveform data (DCF) to change the tone of the musical sound, amplitude limitation (DCA), or even effect addition. As those functions are added, the number of operations/calculations increases, so that a plurality of LSIs are required to share the synthetic function, as mentioned above. Therefore, the use of a plurality of LSIs increases cost, complicates the design of delivery/reception of data between LSIs is complicated and invites limitations on the processing speed, disadvantageously.

Construction of a sound source device so as to produce musical effects only includes only addition of musical effects to a generated musical sound and outputting the result and cannot perform operations such as outputting only a musical sound to which no effects are added, the use of a separate external effect circuit provided without using the internal effect producing circuit, or mixing the internal effect output and the external effect circuit output and outputting the resulting effect.

That is, the conventional generator only performs operations for imparting internal effects to a musical sound and cannot obtain a wide variety of aspects of effect addition, disadvantageously.

SUMMARY OF THE INVENTION

The present invention is intended to solve the above problems. It is an object of the present invention to provide a musical sound generator which performs all the basic operations for generating a musical sound, using a single LSI.

According to one aspect of the present invention, there is provided a musical sound generator comprising:

coefficient memory means for storing a plurality of coefficients to determine the characteristic of a musical sound; and signal processing means for performing, in a single cycle of a synchronous signal, a pitch process which generates musical sound waveform data having a pitch frequency corresponding to pitch data received for each cycle of a predetermined synchronous signal on the basis of a coefficient from the coefficient memory means, a filtering process which filters musical sound waveform data produced by the pitch process performed in the cycle preceding the cycle in which the pitch process was perform/ed, and an amplitude process which controls the filtered musical sound waveform data so as to change the amplitude of a musical sound generated on the basis of the waveform data and output the resulting musical sound.

According to this arrangement, the pitch process, the filtering process and the amplitude process which are the basic process for generating a musical sound are performed by single signal processing means, and there is no need for causing these processes to be shared by a plurality of LSIs, so that an increase in the cost and complication in design are avoided.

It is another object of the present invention to provide a musical sound generator which is capable of outputting the produced musical sound data from a plurality of output terminals in addition to the basic process for generating a musical sound using a single LSI.

According to one aspect of the present invention, there is provided a musical sound generator comprising:

coefficient memory means for storing a plurality of coefficients to determine the characteristic of a musical sound; and signal processing means for performing, in a single cycle of a synchronous signal, a pitch process which generates musical sound waveform data having a pitch frequency corresponding to pitch data received for each cycle of a predetermined synchronous signal on the basis of a coefficient from the coefficient memory means, a filtering process which filters musical sound waveform data produced by the pitch process performed in the cycle preceding the cycle in which the pitch process was performed, an amplitude process which controls the filtered musical sound waveform data so as to change the amplitude of a musical sound generated on the basis of the waveform data and output the resulting musical sound, and an output process for delivering musical sound waveform data from the amplitude process performed in the cycle preceding the cycle in which the former amplitude process may be performed to a plurality of output terminals and for giving at the plurality of output terminals different weights to the musical sound waveform data delivered to the plurality of output terminals.

According to this arrangement, in addition to the basis process for producing a musical sound, the process for outputting the produced musical sound as a stereophonic sound is preformed by the single signal processing means. Therefore, a stereophonic effect and a panning effect are imparted without using an external circuit.

It is a further object of the present invention to provide a musical sound generator which is capable of imparting an effect to the produced musical sound data in addition to the basic processing for producing a musical sound, using a single LSI.

According to one aspect of the present invention, there is provided a musical sound generator comprising:

coefficient memory means for storing a plurality of coefficients to determine the characteristic of a musical sound; and signal processing means for performing, in a single cycle of a synchronous signal, a pitch process which generates musical sound waveform data having a pitch frequency corresponding to pitch data received for each cycle of the predetermined synchronous signal on the basis of a coefficient from said coefficient memory means, a filtering process which filters musical sound waveform data produced by the pitch process performed in the cycle preceding the cycle in which the pitch process was performed, an amplitude process which controls the filtered musical sound waveform data so as to change the amplitude of a musical sound generated on the basis of the waveform data and output the resulting musical sound, an output process for delivering musical sound waveform data from the amplitude process performed in the cycle preceding the cycle in which the former amplitude process may performed to a plurality of output terminals and for giving at the plurality of output terminals different weights to the musical sound waveform data delivered to the plurality of output terminals, and an effect process for imparting an effect to at least one of the musical sound waveform data from the amplitude process performed in the cycle preceding the cycle in which the output process was performed.

According to this arrangement, a musical sound to which an effect is imparted are output simultaneously together with musical sounds produced by the basic process. Therefore, a process for imparting an effect which conventionally requires an external circuit is achieved using a single LSI which produces the musical sound.

It is a still further object of the present invention to provide a single LSI musical sound generator which includes a built-in effector and which is capable of using an external effect circuit optionally in addition to the built-in effector.

According to one aspect of the present invention, there is provided a musical sound generator comprising:

coefficient memory means for storing a plurality of coefficients to determine the characteristic of a musical sound;

signal processing means for performing, in a single cycle of the synchronous signal, a pitch process which generates musical sound waveform data having a pitch frequency corresponding to pitch data received for each cycle of the predetermined synchronous signal on the basis of a coefficient from said coefficient memory means, a filtering process which filters musical sound waveform data produced by the pitch process performed in the cycle preceding the cycle in which the pitch process was performed, an amplitude process which controls the filtered musical sound waveform data so as to change the amplitude of a musical sound generated on the basis of the waveform data and output the resulting musical sound, an output process for delivering musical sound waveform data from the amplitude process performed in the cycle preceding the cycle in which the former amplitude process may performed to a plurality of output terminals and for giving at the plurality of output terminals different weights to the musical sound waveform data delivered to the plurality of output terminals, and an effect process for imparting an effect to at least one of the musical sound waveform data from the amplitude process performed in the cycle preceding the cycle in which the output process was performed;

gate means receiving the musical sound waveform data, which was subjected to the effect process, from the signal processing means and the musical sound waveform data directly output from the output process and outputting at least one of both the musical sound waveform data depending on of an external operation; and mixing means for mixing musical sound waveform data from the gate means and outputting the resulting data.

According to this arrangement, any one of musical sound waveform data to which an effect is already imported, musical sound waveform data to which no effects are imported, and mixed data of both the former data can be selected from the single LSI which is also capable of performing an effect process in addition to a basic process involving generation of musical sounds. Therefore, in addition to an effect due to the internal circuit, an effect due to the use of the external effect circuit and different from the former effect and a mixed effect of both those effects; that is, a wide variety of effects are imparted to the musical sound waveforms.

BRIEF DESCRIPTION OF THE DRAWINGS

These and other objects and features of the present invention will be easily understood by those skilled in the art from the following description concerning a preferred embodiment of the present invention when taken together with the accompanying drawings.

In the drawings:

FIGS. 1–22 show a first embodiment of a signal processor of an electronic musical instrument according to the present invention;

FIG. 1 is a schematic of an overall sound source device of the electronic instrument;

FIG. 2 is a timing chart indicative of the output of a timing generator of the sound source device;

FIG. 3 is a functional block diagram of the sound source device of the electronic device;

FIG. 4 is a schematic of the internal circuit of a DSP (Digital Signal Processor) of the sound source device;

FIG. 5 is a timing chart indicative synthetically of the flow of signals in the DSP;

FIG. 6 is a functional block diagram of an envelope generator of the sound source device;

FIG. 7 is a timing chart indicative of the output of the envelope generator;

FIG. 8 is a functional block diagram of a musical sound data reader of the sound source device;

FIG. 9 is a timing chart indicative of the operation of a musical data reader of the sound source device;

FIG. 10 is a block diagram of a RAM block of the sound source device;

FIG. 11 is a timing chart indicative of the outputs of F-RAM, W-RAM and V-RAM of the RAM block;

FIG. 12 is a functional block diagram of an address counter of the sound source device;

FIG. 13 is a timing chart indicative of the operation of the address counter;

FIG. 14 is a functional block diagram of an interpolation circuit of the sound source device;

FIG. 15 is a timing chart indicative of the operation of an interpolation circuit of the sound source device;

FIG. 16 is a functional block diagram of a digital filter of the sound source device;

FIG. 17 is a virtual block diagram of a filter to realize the digital filter circuit;

FIG. 18 is a timing chart indicative of the operation of the digital filter circuit;

FIG. 19 is a functional block diagram of a level control circuit of the sound source device;

FIG. 20 is a timing chart indicative of the operation of the level control circuit;

FIG. 21 is a functional block diagram of the output circuit of the sound source device;

FIG. 22 is a timing chart indicative of the operation of the output circuit;

FIGS. 23-33 show a second embodiment of a signal processor of the electronic musical instrument according to the present invention;

FIG. 23 is a schematic of the entire sound source device of the electronic musical instrument;

FIG. 24 is a functional block diagram of a sound source device of the electronic musical instrument;

FIG. 25 is a timing chart indicative of the output of an envelope generator of the sound source device;

FIG. 26 is a timing chart indicative of the outputs of F-RAM, W-RAM, and V-RAM of a RAM block of the sound source device;

FIG. 27 shows the function of the internal circuit of a DSP of the sound source device;

FIG. 28 is a schematic of the internal circuit of an effect DSP of the sound source device;

FIG. 29 is a timing chart indicative synthetically of the flow of signals in the DSP;

FIG. 30 is a functional block diagram of the output circuit of the sound source device;

FIG. 31 is a timing chart indicative of the operation of the output circuit;

FIG. 32 is a functional block diagram of an effect processor of the sound source device;

FIG. 33 is a timing chart indicative of the operation of the effect processor;

FIGS. 34-42 show a third embodiment of the musical sound generator according to the present invention;

FIG. 34 shows the overall structure of the musical sound generator;

FIG. 35 is a functional block diagram of the musical sound generator;

FIG. 36 is the internal structure of a DSP of the musical sound generator;

FIG. 37 is a timing chart indicative synthetically of the flow of signals in the DSP;

FIG. 38 is a functional block diagram of the output circuit of the musical sound generator;

FIG. 39 is a timing chart indicative of the operation of the output circuit;

FIG. 40 is a timing chart indicative of the operation of the effect and chorus processing unit of the output circuit;

FIG. 41 is a timing chart of indicative of a musical sound output control unit of the musical sound generator; and FIG. 42 is a block diagram of a musical sound output control block of the musical sound generator.

DETAILED DESCRIPTION OF THE PREFERRED EMBODIMENTS

FIGS. 1-22 show a first embodiment of a signal processor of an electronic musical instrument according to the present invention and applied to a sound source device of the electronic musical instrument.

Figure 1:
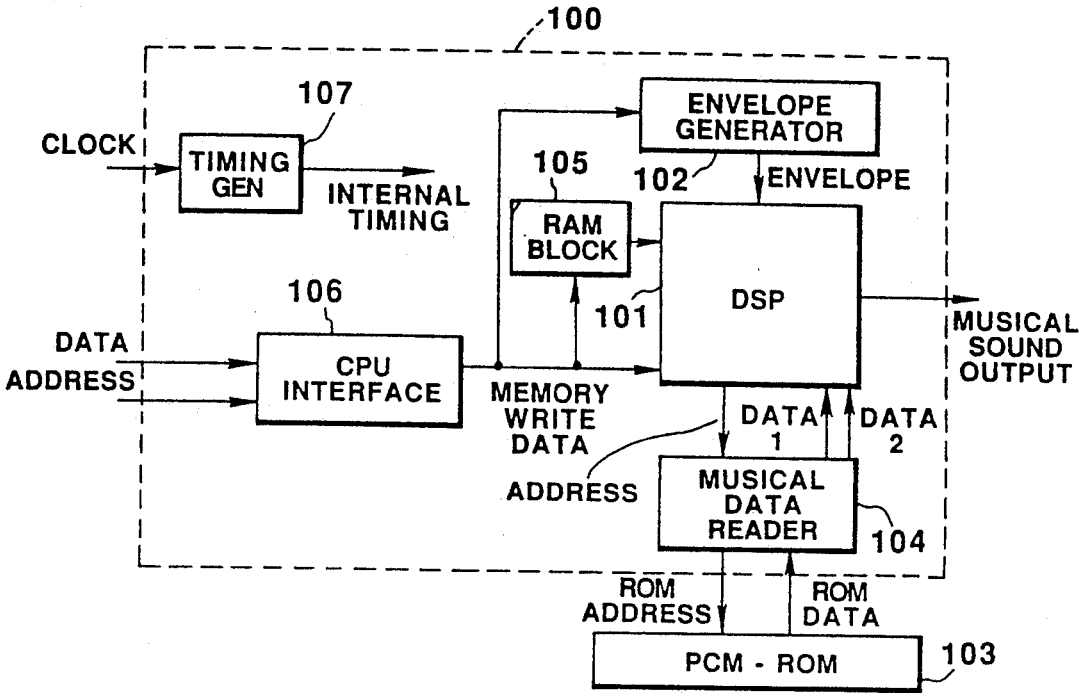

First, the structure of the sound source device will be described. FIG. 1 is a block diagram indicative of the overall structure of the source sound device 100 of the electronic musical instrument. In FIG. 1, the sound source device 100 is also a signal processor which includes various functions combined synthetically, as will be described in more detail, and made of a single LSI. Sound source 100 includes DSP (Digital Signal Processor) 101 which performs a concentrated operation to produce a musical sound waveform, envelope generator 102 which generates an envelope by performing an envelope operation only, musical sound data reader 104 which delivers/receives a ROM address and ROM data to/from PCM-ROM 103 which stores PCM data (waveform data) and also delivers/receives an address, data items 1 and 2 to/from DSP 101 to interface PCM-ROM 103 and DSP 101, RAM block 105 which stores various parameters required for generation of a musical sound; CPU interface 106 which delivers/receives data (for example, various parameters such as filter coefficients and/or multi pliers) to/from an external CPU, and timing generator 107 which generates internal timing signals on the basis of an external basic clock.

Figure 2:
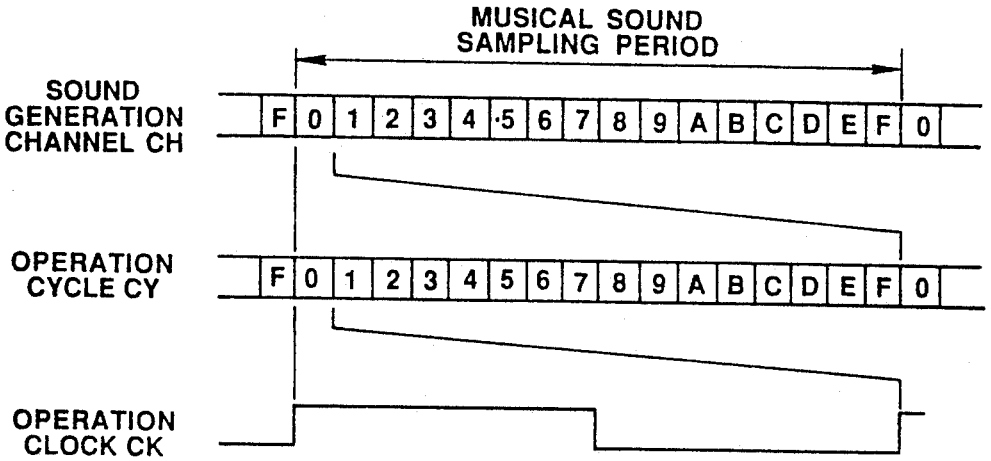

FIG. 2 shows the outputs from timing generator 107. The sound source device 100 of the electronic musical instrument generates signal waveforms and musical sound waveforms in accordance with sound generation channel CH, operation cycle CY and operation clock CK. More particularly, timing generator 107 outputs generation channel CH which controls a plurality of sound generation channels (16 channels in the present embodiment) at a musical sound sampling period of O-F, an operating cycle which controls the operating cycle CY for each sound generation channel, and operation clock CK which controls the result of the operations for each operating cycle. One period of the sound generating channel CH is equal to a period of sampling the musical sound.

Figure 3:
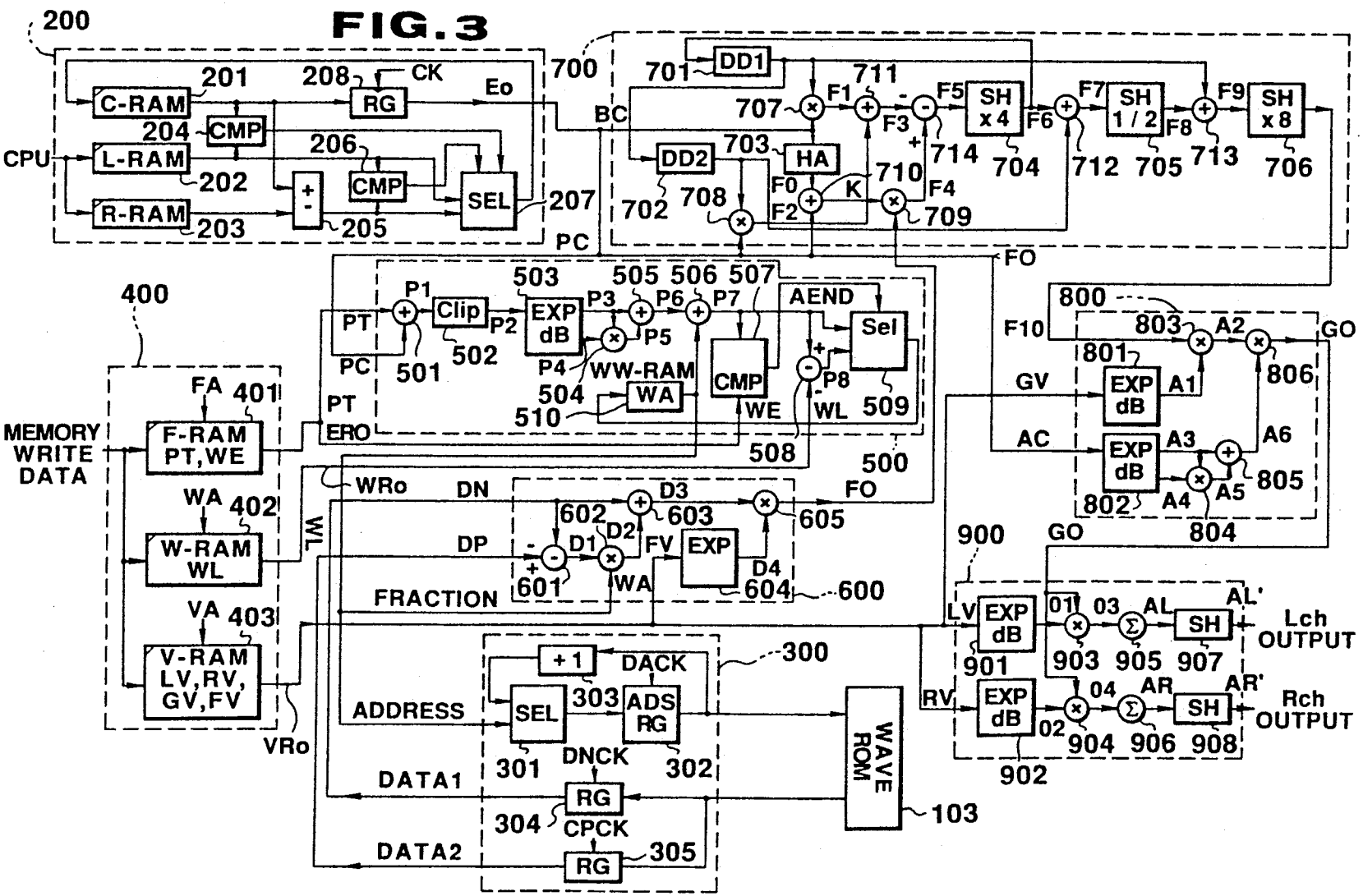

FIG. 3 is a functional block diagram indicative of the overall operation of sound source device 100 of the electronic musical instrument. Sound source device 100 includes various functional blocks described below. In FIG. 3, sound source device 100 comprises envelope generator 200 (corresponding to envelope generator 102 of FIG. 1) which delivers envelopes to the respective elements of the sound source device and described later in more detail, musical sound data reader 300 (corresponding to data reader 104 of FIG. 1) which reads musical sound data from PCM-ROM (waveform ROM) 103, RAM block 400 (corresponding to RAM block 105 of FIG. 1) which stores predetermined RAM data, address counter 500 which performs a PCM memory address stepping operation, interpolator 600 which performs linear interpolation of PCM memory data and filter input volume multiplication, digital filter 700 which performs a digital filtering operation, level control unit 800 which controls the level of the amplitude envelope (instantaneous value), and output circuit 900 which performs panning and accumulation and provides the results as left channel (Lch) and right channel (Rch) outputs.

Figure 6:
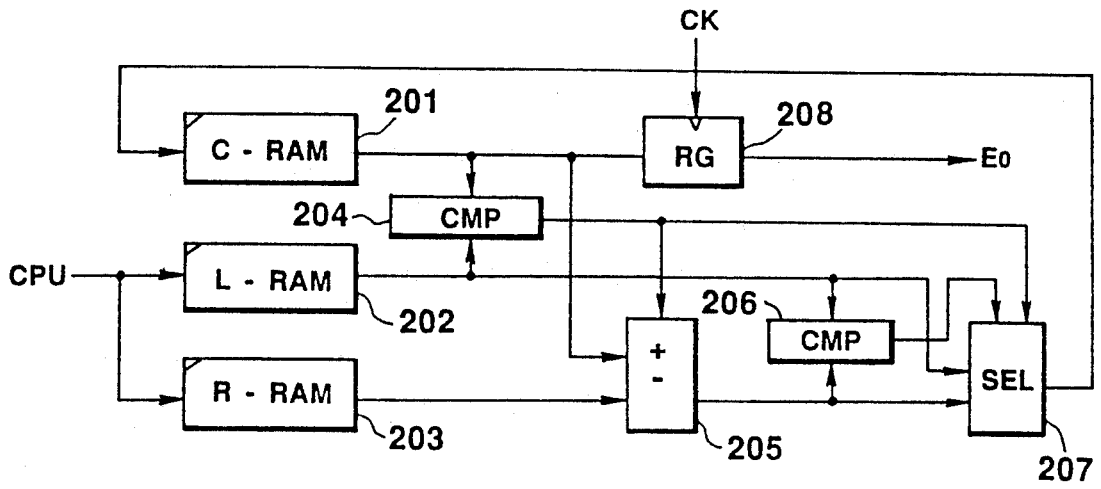

Envelope generator 200 which is shown on enlarged scale in a block diagram of FIG. 6 includes C (current)-RAM 201 which stores the current values of the envelope, L (level)-RAM 202 which stores a target level or value of an envelope output from the CPU, R (rate)-RAM 203 which stores data on a stepping rate of the envelope output from the CPU, comparator 204 which compares the target level and the current value to determine the direction of stepping and outputs the result of the comparison to adder-subtracter 205 and selector 207 to be described later in more detail, adder-subtracter 205 which adds subtracts the rate to/from the current value in accordance with a command from comparator 204, comparator 206 which determines whether the output from adder-subtracter 205 exceeds the level and outputs the result of the determination to selector 207, selector 207 which determines the next current value in accordance with commands from comparators 204 and 206 and delivers the determined current value to C-RAM 201, and register 208 which outputs the result of the calculation as envelop output E to DSP 101 on the basis of operating clock CK. Comparator 204 compares the envelope target level and the current value. If the target level is higher than the current value, comparator 204 delivers a signal to change adder-subtracter 205 to an adder for performing an addition. Selector 207 latches the output from L-RAM 202 and the output from adder-subtracter 205 until both those outputs coincide. If both those outputs do not coincide, selector 200 delivers the result of the comparison to C-RAM 201 to cause same to use it as the current value. The value of C-RAM 201 is controlled by clock CK in register 208 to be output as envelope output Eo. The envelope output Eo register 208 will be described in more detail later in FIG. 7.

Figure 8:
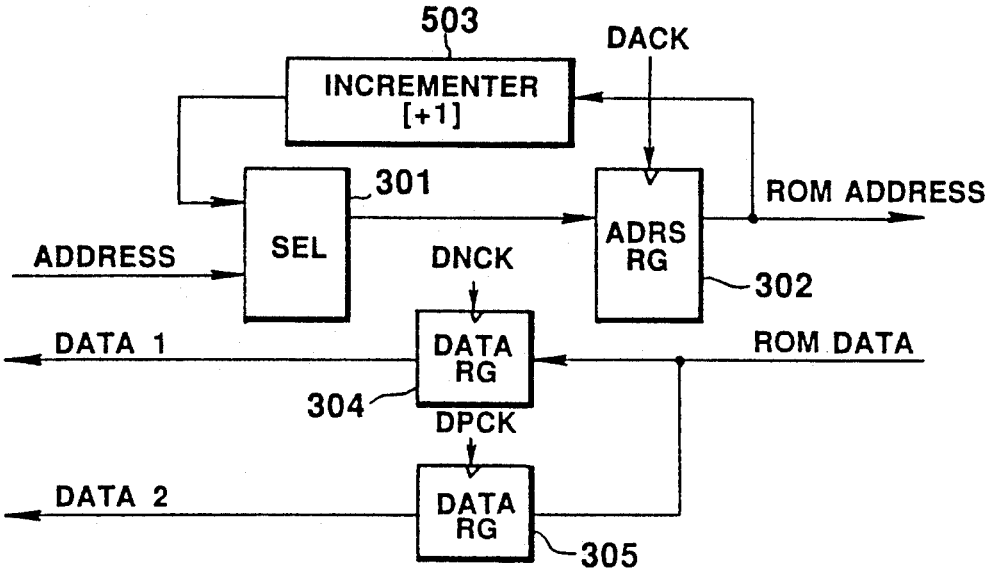

Musical sound data reader 300 reads desired musical data from waveform ROM 103 which stores musical sound data. FIG. 8 is a block diagram of the reader on enlarged scale. Reader 300 includes selector 301 which selects address data from WW-RAM 1002 (which will be later described in more detail with respect to FIG. 4) of DSP 101 and data on the next address incremented by incriminator 303, address register 302 which delivers the output from selector 301 as a ROM address in accordance with predetermined clock DACK to external waveform ROM 103 and incriminator 303, incriminator 303 which increments the address next to the input address and outputs the incremented next address, and data registers 304, 305 which receive ROM data read from waveform ROM 103 in accordance with the ROM address and delivers it as data 1 (DN), data 2 (DP) to DSP 101 in accordance with predetermined clock DNCK, DPCK (see FIG. 9).

Figure 10:
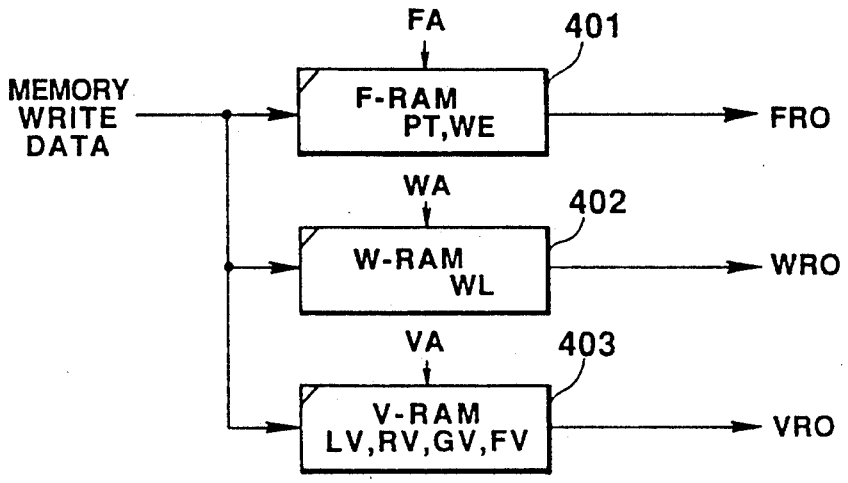

As shown in FIG. 10 on enlarged scale, RAM block 400 includes F (frequency)-RAM 401 which stores end address data WE indicative of center pitch data PT (for example, address data corresponding to the frequency, for example of 440 Hz, of the reference sound of a musical scale) and end address data WE indicative of the end of the waveform to be read, W (wave)-RAM 402 which stores data on loop width WL indicative of a starting address of the waveform loop, Lch and Rch volumes LV, RV a balance between which becomes panning data, subtone volume GV which changes the appropriate circuit in accordance with a changing envelope, and V (volume)-RAM 403 which stores filter input volume FV which prevents clipping in the digital filtering to be adjusted to an appropriate level. The three RAMs (F-RAM 401, W-RAM 402, V-RAM 403) store those data for the respective sound generating channels (for 16 channels, in the present embodiment). Loop width WL stored in W-RAM 402 corresponds to the starting address of the waveform loop. Current address value WA is input to W-RAM 402 in order to read the starting address.

Figure 12:
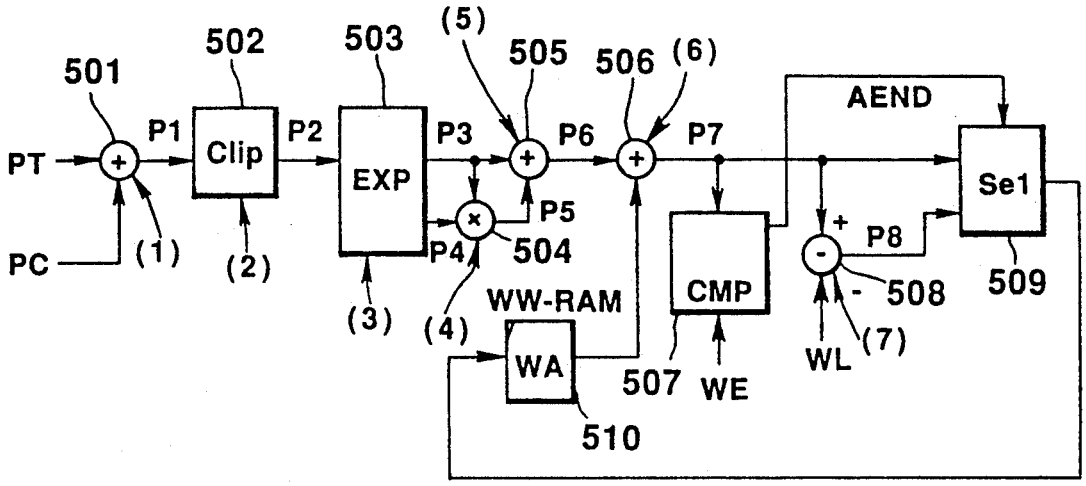

Address counter 500 which is shown on enlarged scale in a block diagram of FIG. 12 includes adder 501 which adds center pitch PT from F-RAM 401 of RAM block 400 and pitch envelope value PC from envelope generator 200 and outputs the result as key code P1, clipper 502 which clips key code P1 in a range of positive numeral values and outputs the result as signal data P2, exponent converter 503 which exponent converts signal data in order to express a scale in decibel, multiplier 504 and adder 505 which perform multiplication and addition, respectively, in order to perform an interpolation for scale exponent conversion, adder 506 which adds the current address value from current address register 510 (to be described later in more detail) to the output from adder 505 and outputs the result as address value P7, comparator 507 which compares address P7 which includes the added current address value and end address WE read from F-RAM 401 and outputs the result of the comparison as AEND flag to selector 509, subtracter 508 which subtracts loop width WL read from W-RAM 402 from address value P7 and outputs the resulting subtraction value P8 to selector 509, selector 207 which selects address value P7 and subtraction value P8 on the basis of the AEND flag, and current address register 510 which uses the added address P7 as the next current address WA when the added address value P7 does not reach end address WE, latches value P8 obtained by subtracting loop width WL from the added address when address value P7 has reaches end address WE and writes value P8 as the next current address into WW-RAM 1002 and outputs the current address value to adder 506.

Figure 14:
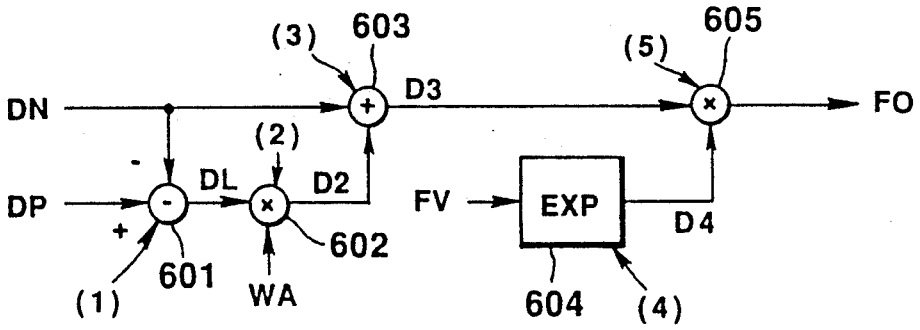

Interpolator 600 which is shown on enlarged scale in a block diagram of FIG. 14 includes subtracter 601 which calculates the differential value between data 1 (DN) and data 2 (NP) from musical sound data reader 300, multiplier 602 which multiplies differential value D1 from subtracter 601 by a fraction of the current address read from WW-RAM 1002, adder 603 which adds multiplication value D2 from multiplier 602 to data 1 (DN) and outputs linearly interpolated value D3, exponent converter 604 which exponent converts filter volume FV read from V-RAM 403 of RAM block 400 and outputs the result as exponent conversion value D4, and multiplier 605 which multiplies value D3 obtained by linear interpolation by exponent conversion value D4 of filter volume FV and writes the result as interpolator 600 output Of into FF-RAM 1001.

Figure 16:
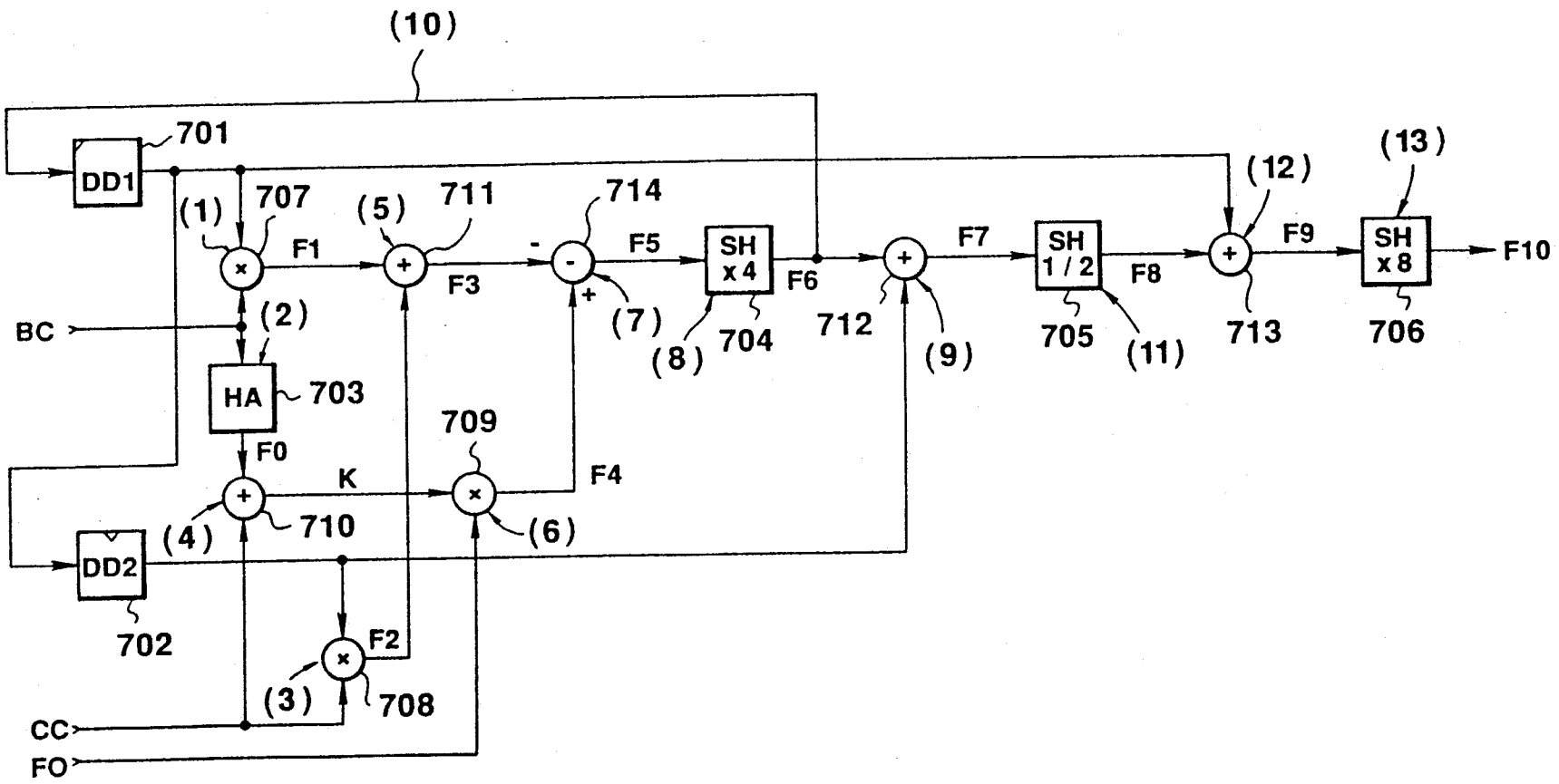

Digital filter 700 which is shown on enlarged scale in a block diagram of FIG. 16 includes delay register (DD1) 701 which stores the last processed data, delay register (DD2) 702 which stores the before-last processed data, half adder (HA 703) which adds filtered coefficient BC output from envelope generator 200, shift circuits 704, 705, 706 each of which shifts a signal input thereto by predetermined times, multipliers 707, 708, 709, adders 710, 711, 712, 713 and subtracter 714.

Figure 19:
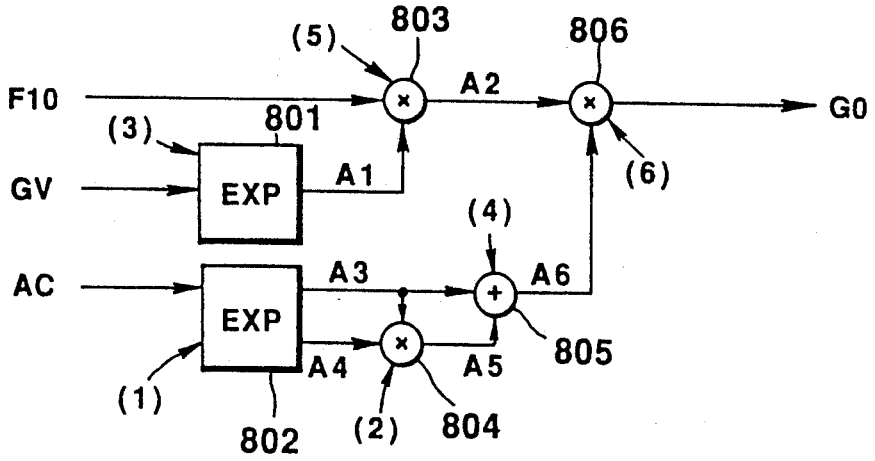

Level control unit 800 which is shown on enlarged scale in a block diagram of FIG. 19 includes exponent converter 801 which exponent converts subtone volume GV read from V-RAM 403 of RAM block 400 and output the result as exponent conversion value A1, exponent converter 800 which exponent converts amplitude envelope AC from envelope generator 200 and outputs the result as exponent conversion values A3, A4, multiplier 803 which multiplies output F10 from digital filter 700 by exponent conversion value A1 of subtone volume GW and outputs the result as product A2, multiplier 804 and adder 805 which interpolate exponent conversion values A3, A4 of amplitude envelope AC, and multiplier 806 which multiplies product A2 by interpolation output A6 from adder 805 and provides outputs the result as output Go of the level control unit 800.

Figure 21:
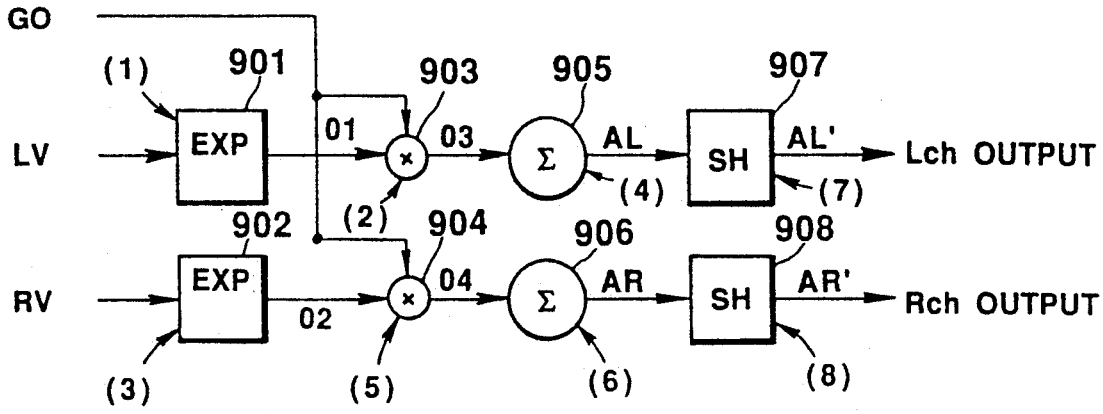

Output circuit 900 which is shown on enlarged scale in a block diagram of FIG. 21 includes exponent converters 901, 902 which exponent convert Lch volume value LV and Rch volume RV read from V-RAM 403 of RAM block 400, multipliers 903, 904 which multiply exponent conversion values 01, 02 by output Go of the level control unit 800, accumulators 905, 906 which respectively accumulate outputs 03, 04 from multipliers 903, 904 and output the results as accumulated data AL, AR, respectively, and shift circuits 907, 908 which shift the data AL, AR by quantities depending on themselves provide final musical sound outputs AL', AR'.

Figure 4:
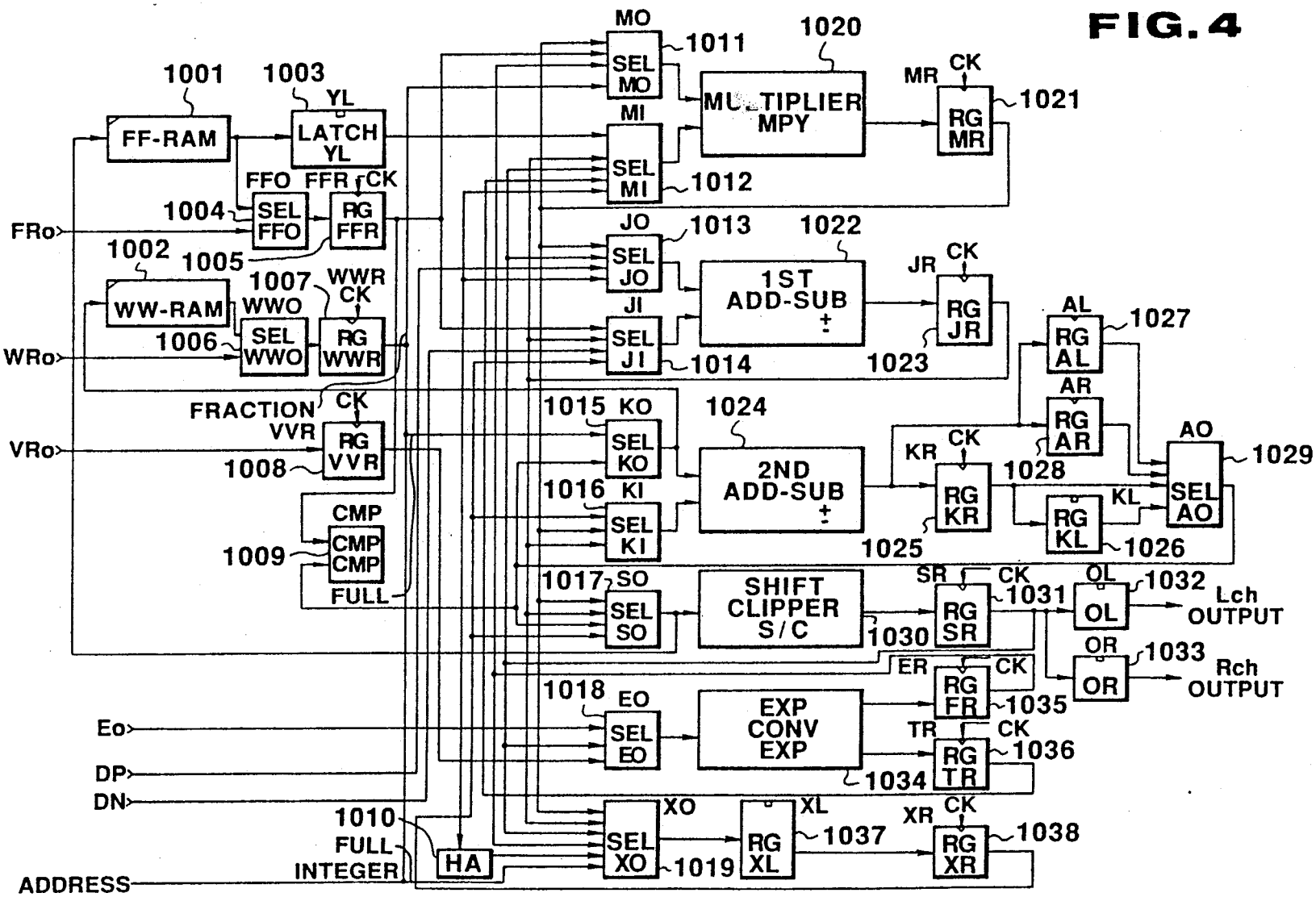

FIG. 4 shows the internal structure of DSP 101. In FIG. 4, FF-RAM 1001 is a memory which stores data of delay registers (DD1) 701, (DD2) 702 of the filter and data buffer Go, Fo for the sound generating channels. WW-RAM 1002 is a memory which stores fractioned current address WA of PCM memory (waveform ROM 103) for the sound generation channels. The output of FF-RAM 1001 is delivered to output latch (YL) 1003 and selector (FFO) 1004. Output FRO from F-401 is input to selector (FFO) 1004, which selects one of the outputs of FF-RAM 1001 and F-RAM 401 and outputs the result to register (FFR) 1005. The output of WW-RAM 1002 is delivered to selector (WWO) 1006 to which output WRO from W-RAM 402 is further input. Selector (WWO) 1006 selects one of these outputs and outputs the selected one to register (WWR) 1007. Output VRO from V-RAM 403 is input to register (VVR) 1008 for latching purposes. The output from register (FFR) 1005 and the output from selector (A0 1029 to be described later in more detail are input to comparator (CMP) 1009, which determines a range of stepping over addresses for the PCM memory on the basis of those output signals. The outputs from latch (YL) 1003, register (FFR) 1005, register (WWR) 1007, register (VVR) 1008, envelope output Eo from envelope generator 200, and data outputs DN (data 1), DP (data 2) from musical sound data reader 300 are input together with the outputs from the respective registers and selectors concerned to the respective input terminals of multiplication input selectors (M0) 1011, (M1) 1012, each including an OR gate, first addition-subtraction input selectors (KO) 1013, (K1) 1016, shift clipper input selector (SO) 1017, exponent conversion input selector (EO) 1018, and general-purpose register input selector (XO) 1019, fraction output data from register (WWR) 1007 is input to selector (M0) 1011 while the full output data from register (WWR) 1007 is input to selectors (KO) 1015 and (XO) 1019. Half adder (HA) 1010 is connected to the input terminal of selector (XO) 1019. Envelope output Eo is input through half adder (HA) 1010 to selector (XO) 1019. The outputs from multiplication input selectors (M0) 1011, (M1) 1012 are input to multiplier (MPY) 1020 where multiplication is made, the result of the multiplication is stored in product output register (MR) 1021, the output of which is delivered to selectors (M0) 1011, (JO) 1013, (K1) 1016, (SO) 1017 and (XO) 1019. The outputs from first addition-subtraction input selectors (J0 1013, (J1) 1014 are input to first adder-subtracter 1022 where addition/subtraction is made and the result of such calculation is stored in first addition-subtraction output register (JR) 1023, the output of which is delivered to selectors (M1) 1021, (J1) 1014, (K1) 1016, (SO) 1017 and (XO) 1019.

The output from second addition-subtraction input selector (KO) 1015 is input to WW-RAM 1002 and also to second adder-subtracter 1024. The output from second addition-subtraction input selector (K1) 1016 is input intactly to second adder-subtracter 1024 and added/subtracted there. The result of such calculation is stored in second addition-subtraction output registers (KR) 1025, (KL) 1026, (AL) 1027, and (AR) 1028. Output register (KL) 1026 is a latch which latches the output of second addition-subtraction output register (KR) 1025. The outputs from second addition-subtraction output registers (KR) 1025, (KL) 1026, (AL) 1027, (AR) 1028 are delivered through second addition-subtraction output selector (AO) 1029 to selectors (KO) 1015, (SO) 1017 and comparator (CMP) 1009. The output from shift clipper input selector (SO) 1017 is input to FF-RAM 1001 and stored through shift clipper (S/C) 1030 into shift clipper output register (SR) 1031, the output from which is delivered to selectors (M1) 1021, (JO) 1013, (EO) 1018 and (XO) 1019 and also input to registers (OL) 1032, (OR) 1033, each including a latch. These registers output left channel (Lch) and right channel (Rch) outputs. The output from exponent conversion input selector (EO) 1018 is input to exponent converter (EXP) 1034 where it is exponent converted and stored in exponent conversion output register (ER) 1035 and exponent fraction conversion output register (TR) 1036. The output from exponent conversion output register (ER) 1035 is delivered to selectors (M0) 1011 and (XO) 1019 while the output from exponent conversion output register (TR) 1036 is delivered to selector (M1) 1012. The output from general-purpose register input selector (XO) 1019 is stored in general-purpose register output register (XR) 1038 through general-purpose register (XL) 1037 comprising a latch. The output from general-purpose register output register (XR) 1038 is delivered to selectors (J1) 1014, (K1) 1016 and (SO) 1017.

The operation of the present embodiment will be described below. FIG. 5 shows a timing chart indicative synthetically of the flow of signals in DSP 101. The operations of the respective functional blocks of sound source device 100 will be described in accordance with this timing chart and timing charts related to the appropriate signals extracted from the former timing chart (FIGS. 13, 15, 18, 20 and 22).

First, FIG. 5 is a timing chart indicative of the flow of signals in one sound generation channel CH (here, the first sound generation channel) and representing the flow of signal data values read in operating cycle CY (of 16 cycles O–F) and stored in the respective selectors and registers concerned. In FIG. 5, the operating cycle of 16 cycles O–F is indicated in row. Sequentially indicated in column are FF-RAM 1001 of DSP 101, output register FFR of FF-RAM, output latch YL of FF-RAM, WW-RAM 1002, output register WWR of WW-RAM, register VVR which latches the output from V-RAM, envelope output Eo data 1 (DN) read from waveform ROM, data 2 (DP) read from waveform ROM, multiplication input selectors M0, M1, product output selector MR, first addition-subtraction input selectors JO, J1, first addition-subtraction output register JR, second addition-subtraction input selectors K0, K1, second addition-subtraction input registers KR, KL, AL, AR, second addition-subtraction input selector AO, shift clipper input selector SO, shift clipper output register SR, exponent conversion input selector EO, exponent conversion output register ER, exponent fraction conversion output register TR, general-purpose register input selector XO, and general-purpose register output register XR. Therefore, if the position of a selector (register) in any particular cycle is viewed, the contents of the selector (register) at that point in time can be known. For example, it is indicated that in cycle 0 data DD1o is read from FF-RAM 1001 while in cycle 1 data DD2o is read; in cycle 1 data DD1o is stored simultaneously; current address value WAo is read from WW-RAM; coefficient BC is delivered from the envelope generator; the value of register FFR in the last cycle is stored in multiplication input selector M0; envelope output Eo is stored in M1; and (Eo+0.25) is stored in selector XO.

Figure 7:
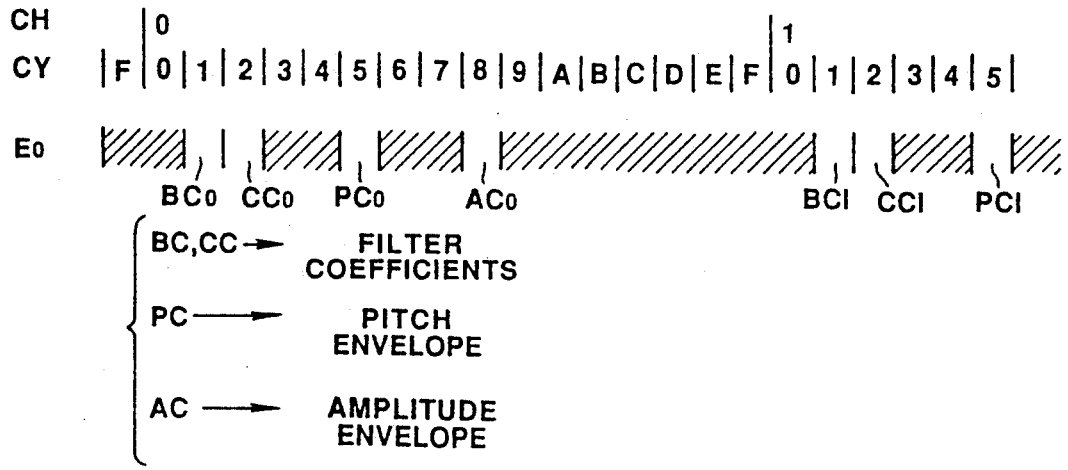

FIG. 6 is a block diagram of envelope generator 200 extracted from FIG. 3. FIG. 7 is a timing chart indicative of output Eo from register 208 of envelope generator 200. As shown in FIG. 7, register 208 of envelope generator 200 provides as output Eo filter efficient BCo ("o" denotes channel 0, which applies to the subsequent cases) in cycle 1 of sound generation channel 0; filter coefficient CCo in cycle 2; pitch envelope PCo in cycle 5; and amplitude envelope ACo in cycle 8. The hatched portion in FIG. 7 shows a high impedance state (Z state) in which no signal data is output from register 208.

As just described above, envelope generator 200 calculates an amplitude envelope, pitch envelope and filter envelope for each sound generation channel. In the filter envelope, coefficients B, C of the filter multiplier are calculated by envelope generator 200.

Figure 9:
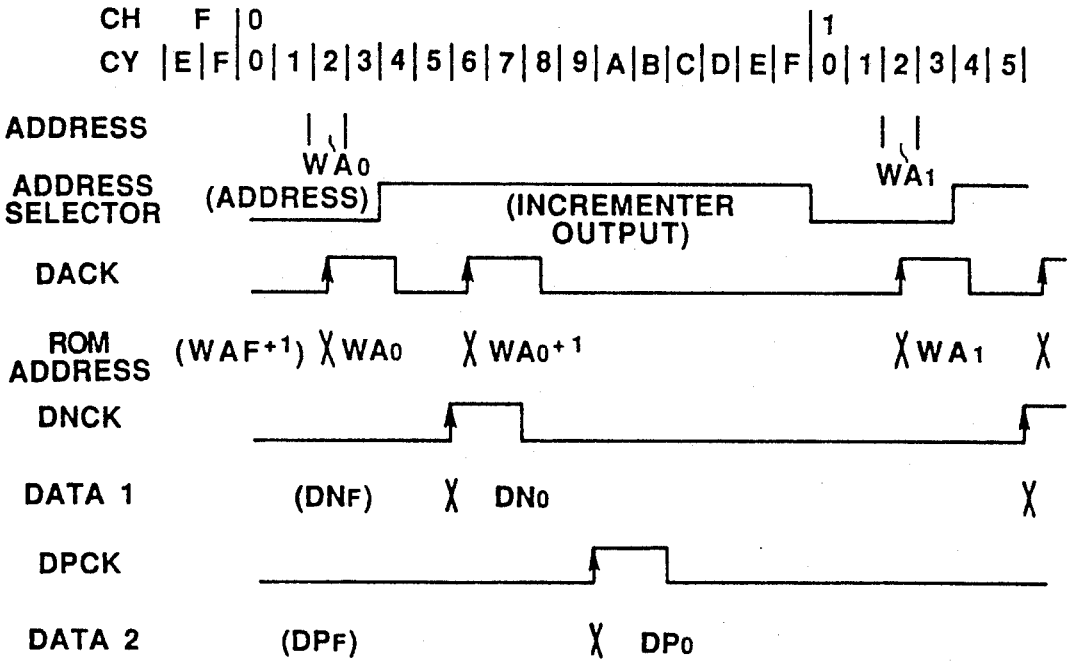

FIG. 8 is a block diagram of musical sound data reader 300 of FIG. 3. FIG. 9 is a timing chart indicative of the operation of sound data reader 300.

In FIG. 8, DSP 101 address data WAo is input to selector 301 at the second (cycle 2) of the operating cycle. Another data address used in linear interpolation is also input to address selector 301 from incriminator 303. Then, address data WAo and incriminator 303 output are output at the timing shown in FIG. 9. The output from address selector 301 is latched by address register 302 and output as an ROM address to the outside (or to waveform ROM 103) synchronously with a rise of clock DACK shown in FIG. 9 and input to incriminator 303 where it is incremented and then output to selector 301. The ROM data read from waveform ROM 103 by the input of the ROM address shown in FIG. 9 is input to and held by data registers 304, 305 and delivered as data 1 (DN), data 2 (DP) to DSP 101 synchronously with clocks DNCK and DPCK shown in FIG. 9.

Figure 11:
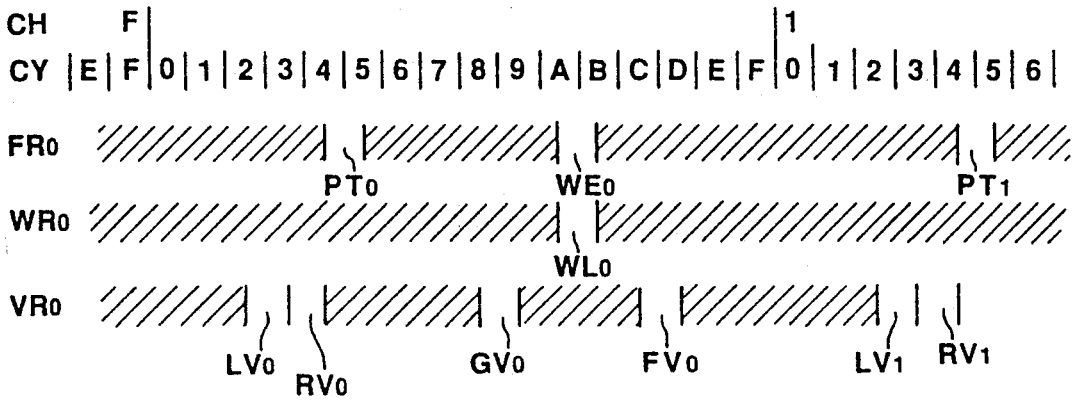

FIG. 10 is a block diagram of RAM block 400 of FIG. 3. FIG. 11 is a timing chart for the outputs of F-RAM 401, W-RAM 402, V-RAM 403 of RAM block 400.

As shown in FIG. 11, center pitch data $PT_0$, $PT_1$ ($PT_1$ indicates the center pitch data of sound generation channel 1) are output from F-RAM 401 between the fourth and fifth cycles of an operating cycle and the next operating cycle in accordance with address FA while end address data WEo is output between cycles A and B. Loop width WLo is output between cycles A and B from W-RAM 402 in accordance with current address WA. Lch volume LVo is output between cycles 2 and 3 in accordance with address VA from V-RAM 403; Rch volume RVo between cycles 3 and 4; subtone volume GVo between cycles 8 and 9; and filter input volume FVo between cycles C and D. The reason why each data item is output in a half cycle between a cycle and the next cycle is to insures supply of data for signal processing performed by DSP 101 by outputting such data half cycle earlier. The output of data in a half cycle is performed in FIG. 11 alone in the present embodiment.

Figure 13:
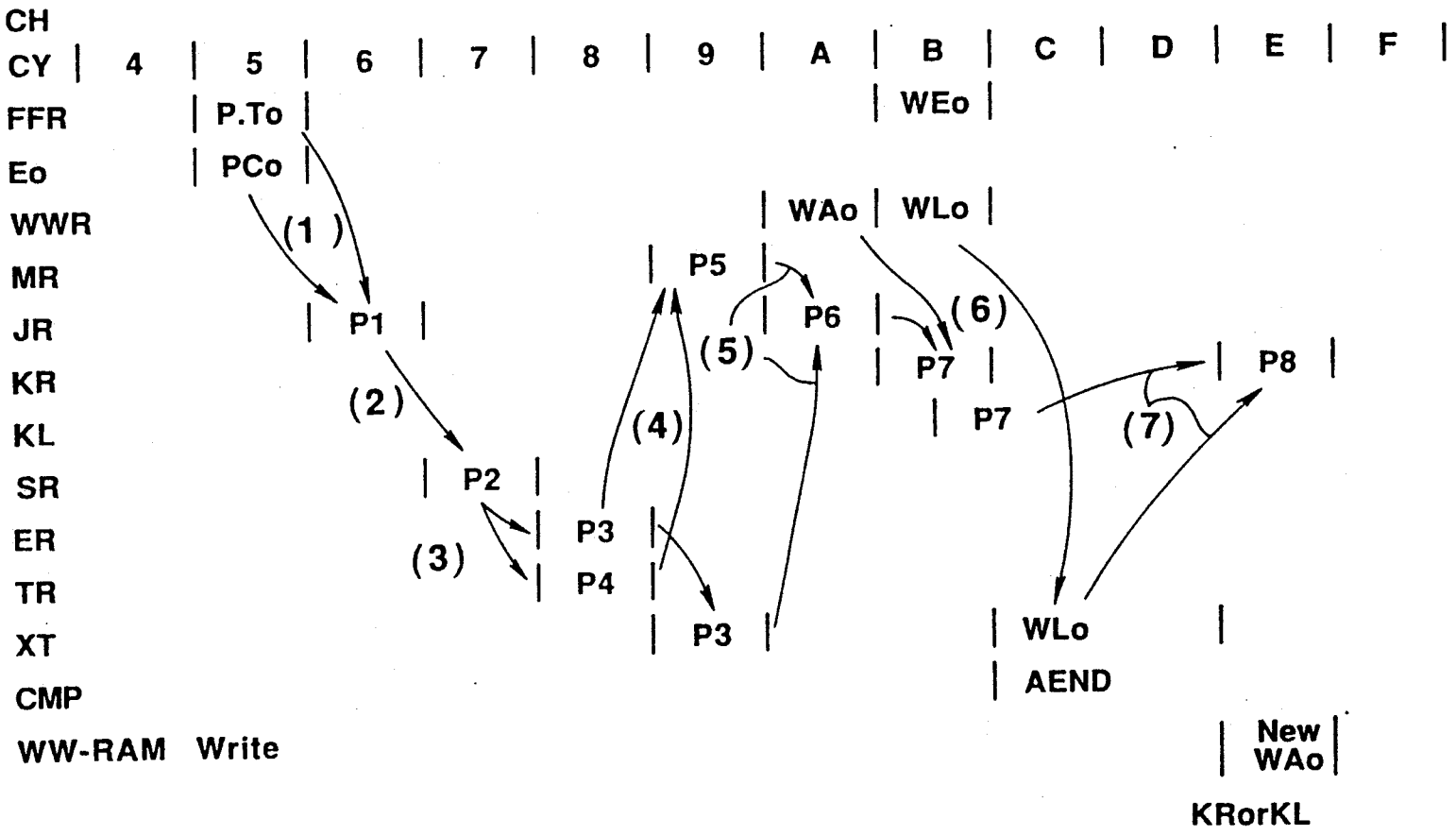

FIG. 12 is a block diagram of address counter 500 of FIG. 3. FIG. 13 is a timing chart indicative of the operation of address counter 500.

The timing chart of FIG. 13 is an extraction of the overall timing chart of FIG. 5 and directed to the selector (register) required for implementing address counter 500. The signs (1)-(7) of FIGS. 12 and 13 are used for explaining the state of the operation or the flow of signal data.

First, in a fifth cycle (hereinafter referred simply to as cycle 5, and this applies to other cycles) of channel #0, center pitch data PTo read from F-RAM 401 is set in output register (FFR) 1005 and pitch envelope value PCo from envelope generator 200 is outputted from exponent conversion input selector (EO) 1018. In cycle 6, pitch envelope value PCo is outputted from exponent conversion input selector (EO) 1018. In cycle 6, center pitch data PTo set in register (FFR) 1005 is added to pitch envelope value PCo outputted from selector (EO) 1018 and the result is set as key code P1 in first addition-subtraction output register (JR) 1023 (see (1)). As shown in (1) of FIG. 12, this corresponds to the operation of the address counter 500 in which center pitch data PTo input to adder 501 is added to pitch envelope value PCo and the result is output as data P1 to clipper 502. In cycle 7, key code P1 set in register (JR) 1023 is clipped in a range of positive numerical values by shift clipper 502 and the result is set as signal data P2 in shift clipper output register (SR) 1031 (see (2)). In cycle 8, signal data P2 set in register (SR) 1031 is exponent converted by exponent converter 1034 and the integer portion of the result is set as integer portion data P3 in exponent conversion output register (ER) 1035 to express signal data P2 in decibel and as integer portion data P4 in exponent fraction conversion output register (TR) 1036 to calculate a fraction value (see (3)). In cycle 9 integer portion data P3 and P4 set in registers (ER) 1035 and (TR) 1036 are multiplied and the result is set as fraction portion data P5 in product output selector (MR) 1021 (see (4)), and integer portion data P3 in register (ER) 1035 is transferred to general-purpose register output register (XR) 1038. In cycle A integer portion data P3 set in general-purpose register output register (XR) 1038 is added to fraction portion data P5 set in product output selector (MR) 1021 and the result P6 is set in first addition-subtraction output register (JR) 1023 (see (5)), and address value WAo of WW-RAM 1002 is set in output register (WWR) 1007. As shown in (4) of FIG. 12, integer portion data P4 output from exponent converter 503 is multiplied by integer portion data P3 in multiplier 504 to calculate fraction portion data P5 to which integer portion data P3 is added in adder 505 to provide the resulting addition value P6. In cycle B addition value P6 set in first subtraction output register (JR) 1023 is added to address value WA of output register (WWR) 1007 and the resulting addition value P7 is set in second addition-subtraction output register (KR) 1025 (see (6)) and, a half cycle later, addition value P7 set in output register (KR) 1025 is transferred to second addition-subtraction output register (KL) 1026. Addition value P7 transferred to output register (KL) 1026 is held even in the subsequent cycles in output register (KL) 1026. This is indicated by the fact that there is no dividing bar at the position of the appropriate register of FIG. 13 (this applies similarly to the subsequent cases). In cycle B end address WE read from F-RAM 401 is set in output register (FFR) 1005 and loop width WLo read from W-RAM 402 is set in output register (WWR) 1007. In cycle C loop width WLo set in output register (WWR) 1007 is transferred to and held by general-purpose output register (XR) 1038 until the next cycle D comes. Simultaneously, addition value P7 set in output register (KL) 1026 and end address WE set in output register (FFR) 1005 are compared in comparator (CMP) 1009 and the result is held as read end address AEND. In cycle E loop width WLo set in output register (XR) 1038 is subtracted from addition value P7 set in output register (KL) 1026 and the resulting subtraction value P8 is set in output register (KR) 1025 (see (7)). Selector 509 selects one of subtraction value P8 set in output register (KR) 1025 and addition value P7 set in output register (KL) 1026 in accordance with end address AEND and the result of the selection is written as new address value WAo in WW-RAM 1002. As just described above, by signal data processing such as that shown in FIG. 13 in DSP 101 of FIG. 4, address counter 500 shown in FIGS. 3 and 12 is implemented to thereby achieve the preparation of a desired address.

Figure 15:
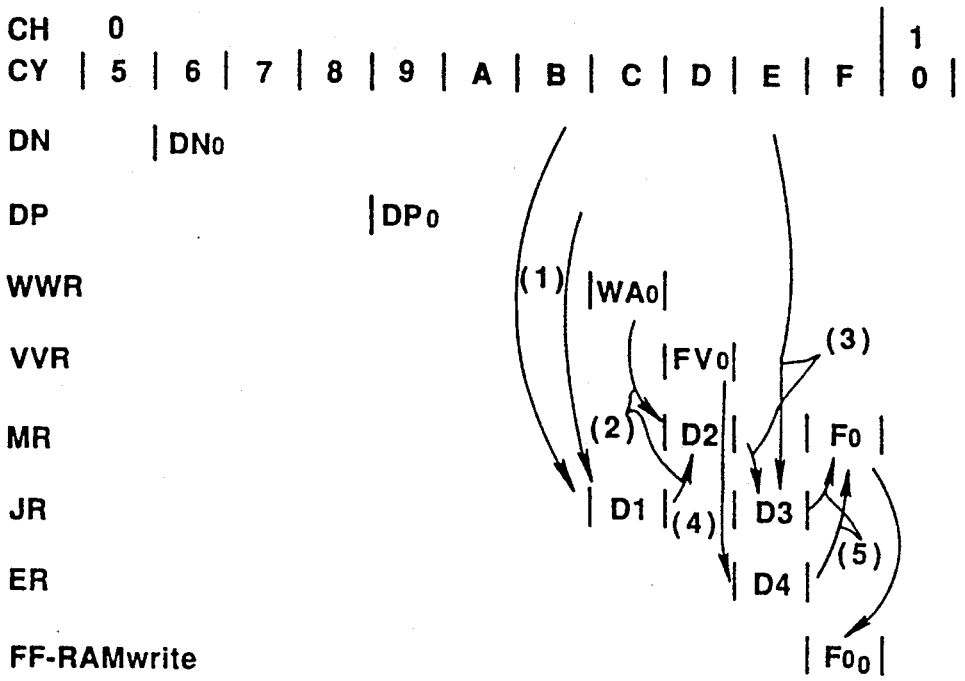

FIG. 14 is a block diagram of interpolator 600 of FIG. 3, and FIG. 15 is a timing chart indicative of the operation of interpolator 600.

The timing chart of FIG. 15 is an extraction of the overall timing chart shown in FIG. 5 directed to the selector (register) required for implementing interpolator circuit 600. The signs (1)–(5) in FIGS. 14 and are used for explaining the states of the operations or the flow of signal data.

First, in cycle 6 data 1 (DNo) read from waveform ROM 103 is input to interpolator 600 and in cycle 9 data 2 (DPo) is input. In cycle C data 1 (DNo) is subtracted from data 2 (DPo) and the resulting subtraction value D1 is set in first addition-subtraction output register (JR) 1023 (see (1)) and address value WAo is set in output register (WWR) 1007. This corresponds to the operation of the interpolator in which data 1 (DN) is subtracted from data 2 (DP) delivered by musical sound data reader 300 in subtracter 601 to calculate differential value D1 for linear interpolation, as shown in (1) of FIG. 14. In cycle D filter volume FVo read from V-RAM 403 is set in latch register (VVR) 1008, and subtraction value D1 set in output register (JR) 1023 is multiplied by address value WAo set in output register (WWR) 1007 and the resulting product D2 is set in multiplication output selector (MR) 1021 (see (2)). In cycle E input data (DNo) is added to product D2 set in product output selector (M ) 1021 and the resulting addition value D3 is set in first addition-subtraction output register (JR) 1023 (see (3)), and filter volume FVo set in latch register (VVR) 1008 is exponent converted by exponent converter (EXP) 1034 and the resulting exponent conversion value D4 is set in exponent conversion output register (ER) 1035 (see (4)). This corresponds to the operation of the interpolator in which as shown by (2), (3) in FIG. 14, differential value D1 calculated by subtracter 601 is multiplied by count address value WA in multiplier 602 to calculate product D2 corresponding to a fraction portion for linear interpolation, input data 1 (DN) is added to product D2 in adder 603 to provide the resulting linear interpolation output D3. In cycle F addition value D3 set in output register (JR) 1023 is multiplied by exponent conversion value D4 set in exponent conversion output register (ER) 1035 and the resulting product is set as interpolation output Fo in product output selector (MR) 1021 (see (5)) and interpolation output Fo set in interpolation output selector (MR) 1021 is written into FF-RAM 1001. In this way, interpolator 600 of FIGS. 3 and 14 is implemented and data read from waveform ROM 103 is appropriately interpolated and output.

Figure 17:
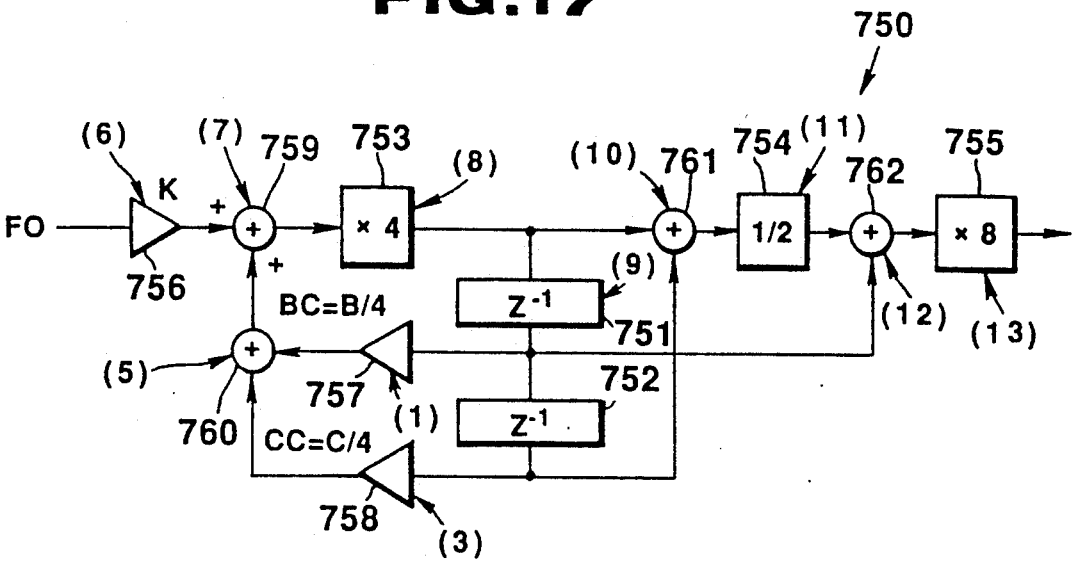

FIG. 16 is a block diagram of digital filter 700 of FIG. 3. FIG. 17 is a virtual block diagram of a filter obtained by developing the digital filter. In FIG. 17, filter 750 includes delay units 751, 752, shift circuits 753, 754, 755 which shift the received signal by predetermined different times, respectively, multipliers 756, 757, 758 which multiply the received signal by predetermined different coefficients, respectively, subtracter 759 and adders 760, 761, 762. Shift circuits 753, 754, 755 shift the received signals at factors of 4, ½ and 8, respectively. Multiplier 757 is supplied with coefficient BC=B/4; multiplier 758 with coefficient CC=C/4; and multiplier 756 with coefficient K calculated by the following equation (1):

$$K=BC+CC+0.25 \quad (1)$$

1010 and the resulting half addition value Fo is set in general-purpose register output register (XR) 1038 (see (2)). As shown by (1), (2) in FIG. 16, this corresponds to the operation of the digital filter in which the last data DD1 output from delay register (DD1) 701 is multiplied by filtering coefficient BCo in multiplier 707 to produce a product value Fl, and coefficient BCo is half added in half adder (HA) 703 to output a half addition value Fo. In cycle 2 the before-last data $DD2_0$ is set in output register (FFR) 1005 and filtering coefficient CCo is set in exponent conversion input selector (EO) 1018. In cycle 3 the before-last cycle data $DD2_0$ set in output register (FFR) 1005 is multiplied by coefficient CCo set in selector (EO) 1018 and resulting product value F2 is set in product output selector (MR) 1021 (see (3)). Simultaneously, coefficient CCo set in input selector (EO) 1018 is added to half addition value Fo set in general-purpose register output register (XR) 1038 and the resulting addition value is set as coefficient K in first addition-subtraction output register (JR) 1023 (see (4)). In cycle 3 interpolation output Fo from interpolator 600 is set in output register (FFR) 1005 and product value Fl set in product output selector (MR) 1021 is transferred to output register (XR) 1038. As shown by (3), (4) in FIG. 16, this corresponds to the operation of the filter in which the before-last data where BC=B/4

$$CC=C/4$$

Coefficient K delivered to multiplier 756 is provided for preventing the level of the circuit from being clipped. To this end, multiplier 756 is provided in the input stage of digital filter 700 to lower the level and finally restores a level corresponding to the lowered level by the subsequent stage shift circuit 755. Half adder (HA) 703 of FIG. 16 is used to calculate "0.25" of equation (1).

Figure 18:
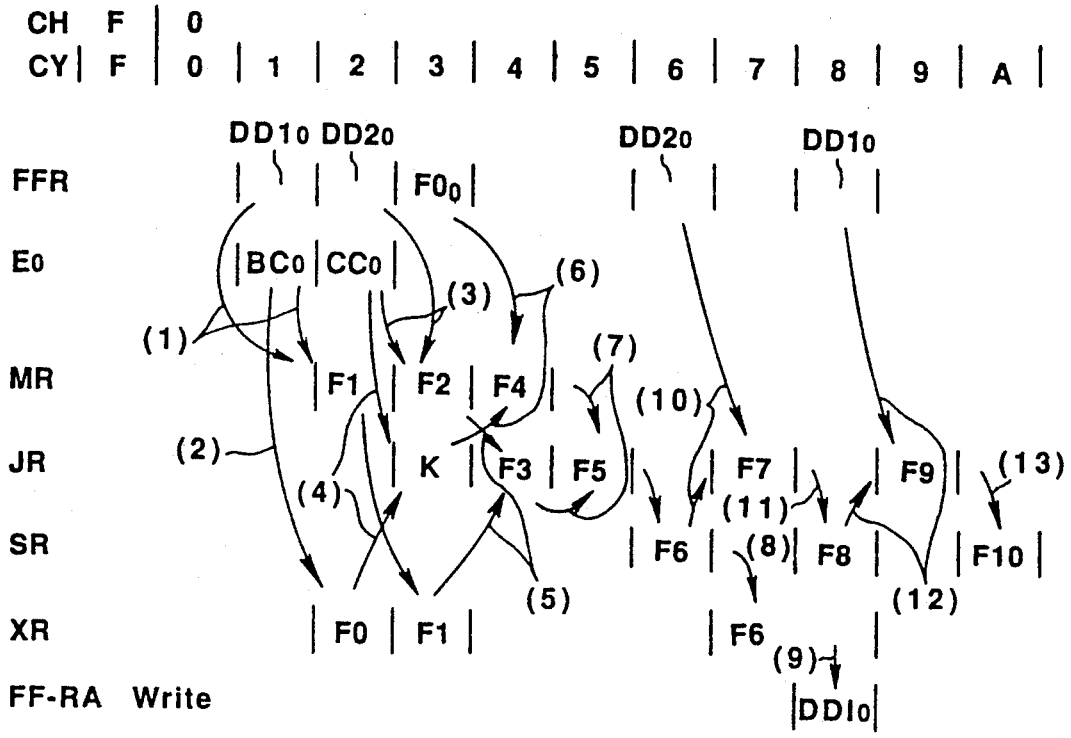

FIG. 18 is a timing chart indicative of the operation of digital filter 700 and an extraction of the overall timing chart of FIG. 5 directed to the selector (register) required for implementing digital filter 700. The signs (1)-(13) in FIGS. 16, 17 and 18 are used for explaining the state of the operation or the flow of signal data.

First, in cycle 1, data DD1 for the last cycle is set in FF-RAM output register (FFR) 1005, and filtering coefficient BCo output from envelope generator 200 is set in exponent conversion input selector register (EO) 1018. In cycle 2 the last data $DD1_0$ set in output register (FFR) 1005 is multiplied by coefficient BCo set in selector (EO) 1018 and the resulting product value Fl is set in product output selector (MR) 1021 (see (1)). Simultaneously, coefficient BCo set in input selector (EO) 1018 is half added through half adder (HA) DD2 output from delay register (DD2) 702 is multiplied by filtering coefficient CCo in multiplier 708 to output product value F2, and output Fo from half adder (HA) 703 is added to coefficient CCo in adder 710 to provide coefficient K in accordance with equation (1). In cycle 4 product value Fl set in output register (XR) 1038 is added to product value F2 set in product output selector (MR) 1021 and the resulting addition value F3 is set in output register (JR) 1023 (see (5)), and interpolation output Fo set in output register (FFR) 1005 is multiplied by coefficient K set in output register (JR) 1023 in cycle 3 and the resulting product value F4 is set in product output selector (MR) 1021 (see (6)). As shown by (5), (6) in FIG. 17 this corresponds to the operation in of the filter which product value Fl is added to product value F2 in adder 711 to provide the resulting addition value F3 and coefficient K is multiplied by interpolation output Fo in multiplier 709 to output the resulting product value F4. In cycle 5 product value F3 set in product output selector (MR) 1021 is subtracted from addition value F3 set in output register (JR) [illegible]3 and the resulting subtraction value F5 is set in output register (JR) 1023 (see (7)). Then, in cycle 6 the before-last data $DD2_2$ is set in output register (FFR) 1005, subtraction value F5 set in output register (JR) 1023 is clipped in shift clipper (S/C 1030 and the resulting clipper output F6 is set in shift clipper output register (SR) 1031 (see (8)). As shown by (8) in FIG. 16, subtraction value F5 is shifted by four times in shift circuit 704. In cycle 7 clipper output F6 set in output register (SR) 1031 is added to data $DD2_0$ set in output register (FFR) 1005 and the result is set as addition value F7 in output register (JR) 1023 (see (9)), and clipper output F6 set in shift clipper output register (SR) 1031 is transferred to general-purpose register output register (XR) 1038. Clipper output F6 transferred to register output register (XR) 1038 is also held for the next cycle 8. In cycle 8 the last data $DD1_0$ is set in output register (FFR) 1005; clipper output F6 stored in general-purpose register output register (X ) 1038 is written into FF-RAM 1001 (see (10)); addition value F7 set in output register (JR) 1023 is clipped in shift clipper (S/C) 1030 and the result is set as clipper output F6 in shift clipper output register (SR) 1031 (see (11)). As shown by (10), (11) in FIG. 16, shift clipper output F6 is returned to delay register (DD1) 701, and addition value F7 is shifted by ½ times in shift circuit 705. In cycle 9 data $DD2_0$ set in output register (FFR) 1005 is added to clipper output F8 set in output register (SR) 1031 and the result is set as addition value F7 in output register (JR) 1023 (see (12)). In cycle A addition value F9 set in output register (JR) 1023 is clipped in shift clipper (S/C) 1030 and the result is set as digital filter 700 output F10 in shift clipper output register (SR) 1031 (see (13)). As shown by (13) in FIG. 16 addition value F9 is level shifted by 8 times in shift circuit 706 and the signal level is returned to a level close to that input to filter 700. As just described above, by signal data processing shown in FIG. 18 on DSP 101 of FIG. 4, digital filter 700 of FIGS. 16 and 17 is implemented to thereby achieve control over various wave forms.

Figure 20:
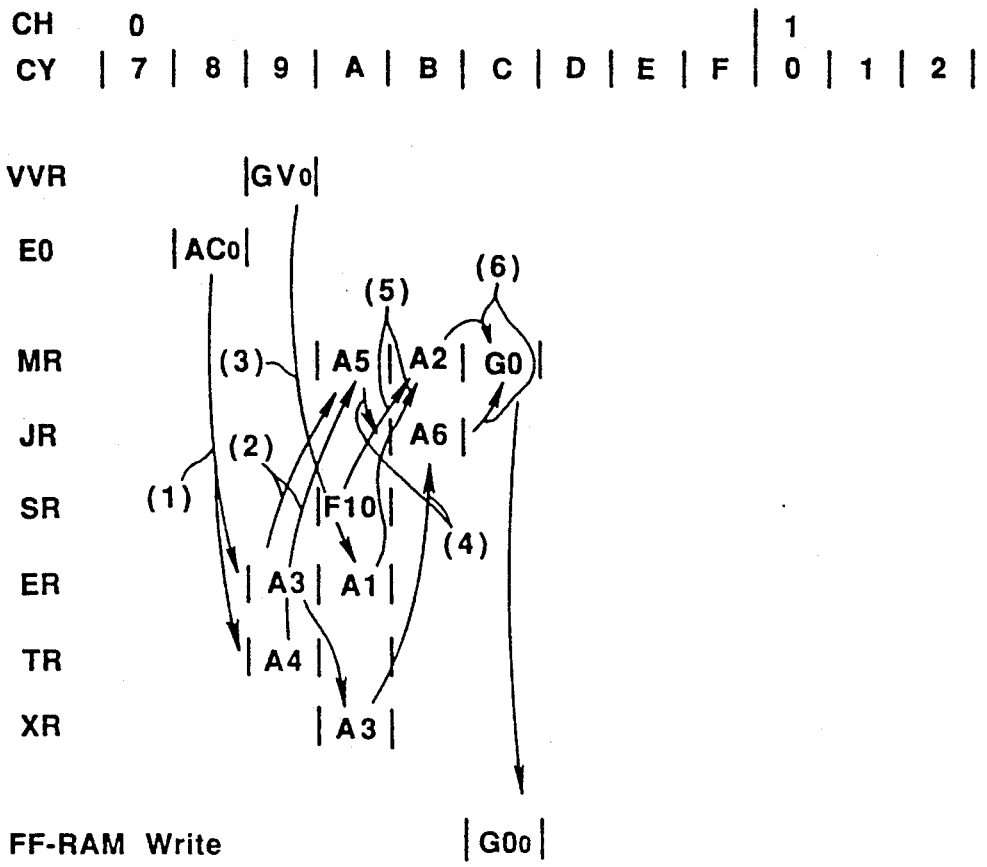

FIG. 19 is a block diagram of level control unit 800 of FIG. 3. FIG. 20 is a timing chart indicative of the operation of level control unit 800.

The timing chart of FIG. 20 is an extraction of the overall timing chart of FIG. 5 directed to a selector (register) required for implementing level control unit 800. The signs (1)-(6) in FIGS. 19 and 20 are used for explaining the state of the operation or the flow of signal data.

First, in cycle 8 amplitude envelope ACo output from envelope generator 200 is set in exponent conversion input register (EO) 1018. In cycle 9 subtone volume GVo from V-RAM 403 is set in register (VVR) 1008 which latches the V-RAM 403 output, amplitude envelope ACo set in exponent conversion input selector (EO) is exponent converted in exponent converter (EXP) 1034 to express amplitude envelope ACo in decibel and the integer portion of the result is set as integer portion data A3 in exponent conversion output register (ER) 1035 and also set as integer data A4 in exponent fraction conversion output register (TR) 1036 for calculation of a fraction value (see (1)). In cycle A integer portion data A3 set in register (ER) 1035 is multiplied by integer portion data A4 set in register (TR) 1036 and the result of the multiplication is set as fraction portion data A5 in multiplication output selector (MR) 1021 (see (2)), and integer portion data A3 in register (ER) 1035 is transferred to general- purpose register output register (XR) 1038. In cycle A (output $F_{10}$ from digital filter 700 is set in shift clipper output register (SR) 1031, and subtone volume GVo set in register (VVR) 1008 is exponent converted in exponent converter (EXP) 1034 to express GVo in decibel, and the integer portion (only the integer portion for GVo) of the result is set as integer portion data Al in exponent conversion output register (ER) 1035 (see (3)). In cycle B integer portion data A3 set in general-purpose register output register (XR) 1038 is added to fraction portion data A5 set in product output selector (MR) 1021 and the resulting addition value A6 is set in first addition-subtraction output register (JR) 1023 (see (5)), and output $F_{10}$ set in clipper output register (SR) 1031 is multiplied by integer portion data Al set in exponent conversion output register (ER) 1035 and the result of the multiplication is set as integer portion data A2 in product output selector (MR) 1021 (see (5)). As shown by (2), (4), in FIG. 19 this corresponds to the operation of the level control unit in which integer portion data A4 output from exponent converter 802 is multiplied by integer portion A3 in multiplier 804 to calculate fraction portion data A5, which is added to integer portion data A3 in adder 805 to output the resulting addition value A6. As shown by (5) in FIG. 19, this corresponds to the operation in which output $F_{10}$ of digital filter 700 is multiplied in multiplier 803 by integer portion data Al output from exponent converter 801 to output the resulting product value A2. In cycle C product value A2 set in multiplication output selector (MR) 1021 is multiplied by addition value A6 set in first addition-subtraction output register (JR) 1023 and the resulting product value is set as level control unit 800 output Go in product output selector (MR) 1021 (see (6)), and output Go set in product output selector (MR) 1021 is written into FF-RAM 1001. In this way, level control unit 800 of FIGS. 3 and 19 is implemented such that filter output $F_{10}$ from envelope generator 200 is added to a constant such as data read from V-RAM 403 to achieve a desired level.

Figure 22:
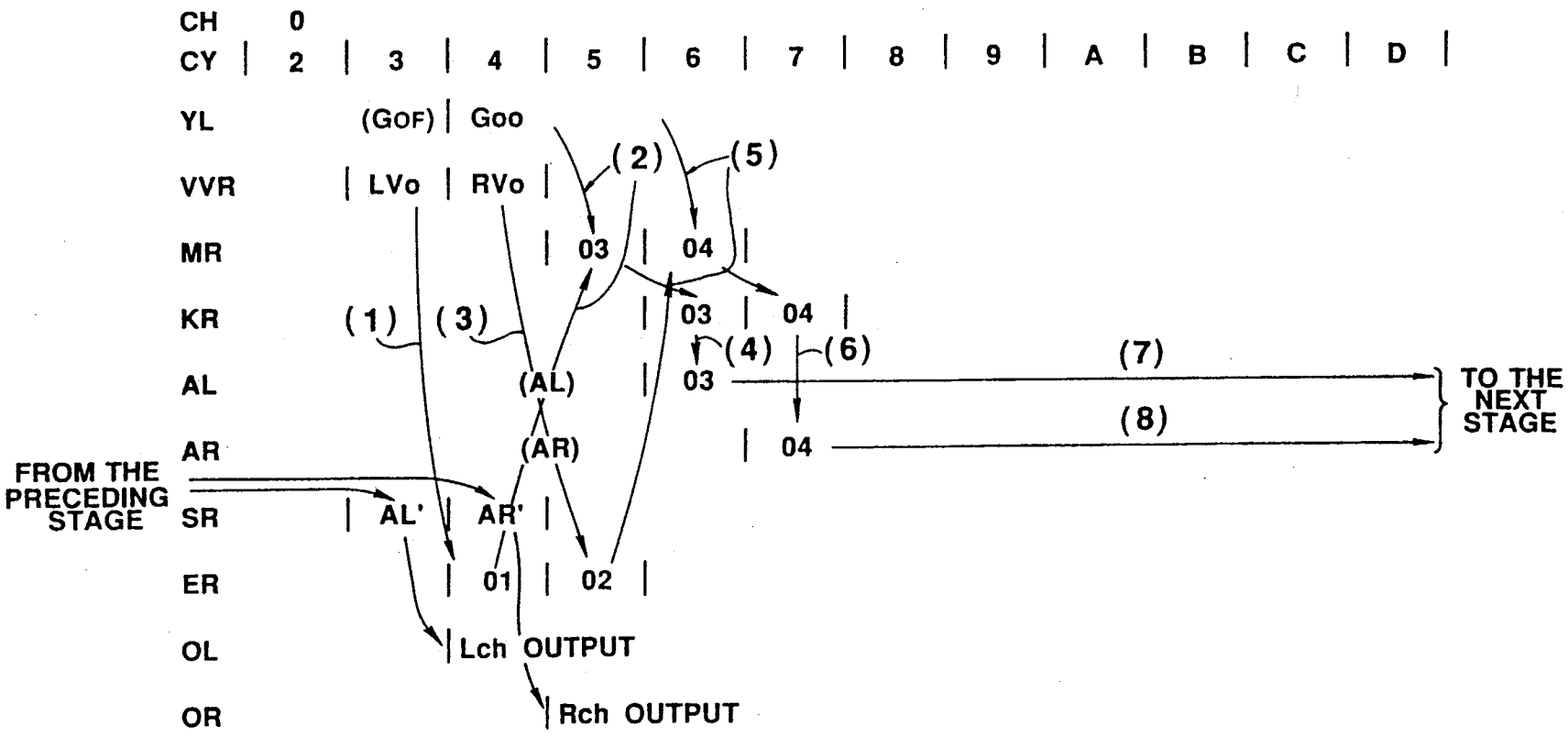

FIG. 21 is a block diagram of output circuit 900 of FIG. 3. FIG. 22 is a timing chart indicative of the operation of output circuit 900.

The timing chart of FIG. 22 is an extraction of the overall timing chart of FIG. 5 directed to a selector (register) required for implementing output circuit 900. The signs (1)–(8) in FIGS. 21 and 22 are used for explaining the state of the operation and the flow of signal data.

First, up to cycle 3 the last output $G_{OF}$ from level control unit 800 is set in output latch (YL) 1003 of FF-RAM 1001. In cycle 3 left channel (Lch) volume LVo from V-RAM 403 is set in register (VVR) 1008 which latches the output from V-RAM 403 and the last final output AL' of the left channel is set in shift clipper output register (SR) 1031. In cycle 4 the current (sound generation channel 0) output GOo from level control unit 800 is set in output latch (YL) 1003. Simultaneously, left channel volume LVo set in register (VVR) 1008 is exponent converted in exponent converter (EXP) 1034 to express LVo in decibel, the resulting exponent conversion value 01 is set in exponent conversion output register (ER) 1035 (see (1)), and right channel (Rch) volume RVo from V-RAM 403 is set in register (VVR) 1008. In cycle 4 the last final musical sound output AL' of the left channel set in shift clipper output register (SR) 1031 is transferred to output register (OL) 1032 and output as the left channel output and right channel (Rch) volume RVo from V-RAM 403 is set in shift clipper output register (SR) 1031. In cycle 5 exponent conversion value 01 set in exponent conversion output register (ER) 1035 and output GOo latched in output latch (YL) 1003 are multiplied and the resulting product output 03 is set in product output selector (MR) 1021 (see (2)) Right channel volume RVo set in register (VVR) 1008 is then exponent converted in exponent converter (EXP) 1034 to express RVo in decibel, the resulting exponent conversion value 02 is set in exponent conversion output register (ER) 1035 (see (3)), and the last final musical sound output AR' of the right channel set in shift clipper output register (SR) 1031 is transferred to output register (OR) 1033 to thereby output AR' as the right channel output. In cycle 6 product output 03 set in selector (MR) 1021 is transferred to second addition-subtraction output register (KR) 1025 and transferred as accumulation output AL to output register (AL) 1027 (see (4)). In addition, exponent conversion value 02 set in exponent conversion output register (ER) 1035 and output GOo latched in output latch (YL) 1003 are multiplied and the resulting product output 04 is set in product output selector (MR) 1021 (see (5)). In cycle 7 product output 04 set in selector (MR) 1021 is transferred to second addition-subtraction output register (KR) 1025 and transferred as accumulation output AR to output register (AR) 1028 (see (6)). Accumulation outputs AL, AR are shifted in shift clipper (S/C) 1030 by a quantity corresponding to the accumulation number to become the final musical sound outputs AL', AR' (see (7), (8)). The accumulation is performed from channel #0 to #F (Och -Fch) and newly performed when the accumulation is returned to channel #0. As just described above, by signal data processing as shown in FIG. 22 on DSP 101 of FIG. 4, output circuit 900 of FIG. 21 is implemented to thereby provide a stereophonic output involving the left and right channel outputs.

As described above, according to the present embodiment and as shown in the timing chart of FIG. 5, signal processing by musical sound data reader 300, signal processing by address counter 500, interpolation by interpolator 600, filtering (DCF) by digital filter 700, level control (DCA) by level control unit 800, and stereophonic outputting by output circuit 900 are performed in parallel, random operation sequence is performed on one-block DSP 101 in a concentrated and time division manner, so that musical sound processing having a complicated operational sequence is achieved without increasing the circuit scale and functions, which have been conventionally achieved by a plurality of LSIs are achieved using a single LSI.

SECOND EMBODIMENT

FIGS. 23–33 show a second embodiment of a signal processor of the electronic musical instrument according to the present invention. This embodiment implements a sound source with an effect function and of the electronic musical instrument. For convenience of description, like elements in the first and second embodiments are identified by the same reference numeral or sign and further description thereof will be omitted.

Figure 23:
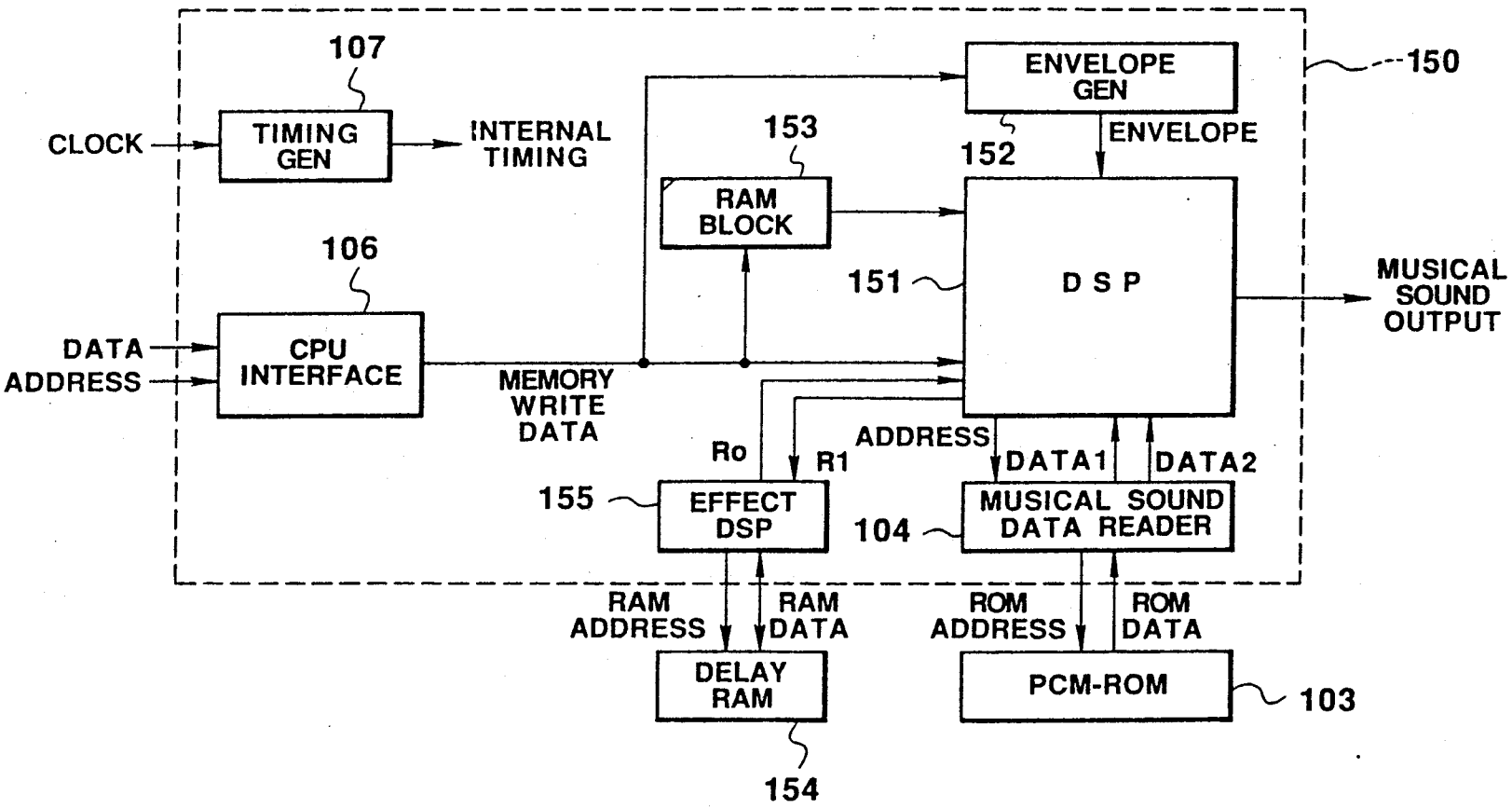

First, the structure of the embodiment will be described. FIG. 23 is a block diagram indicative of the overall structure of sound source 150 of the electronic instrument and corresponds to FIG. 1 indicative of the first embodiment. In FIG. 23, the sound source 150 is a signal processor made of a single LSI and includes DCO (frequency control), DCF (waveform control), DCA (level control) and an effect function combined synthetically. Sound source 150 includes DSP 151 which performs a centralized operation to generate a musical sound waveform, envelope generator 152 which generates an envelope by only performing an envelope operation including an effect amplitude envelope operation to generate an envelope, musical sound data reader 104 which interfaces PCM-ROM 103 and DSP 151, RAM block 153 which stores various parameters required for generation of a musical sound and addition of an echo effect, CPU interface 106 which delivers/receives data (for example, various parameters such as filter coefficients and multipliers) to/from an external CPU, timing generator 107 which generates internal timing on the basis of an external basic clock, and effect DSP 155 which generates an effect using effect DSP delay memory 154.

Figure 24:
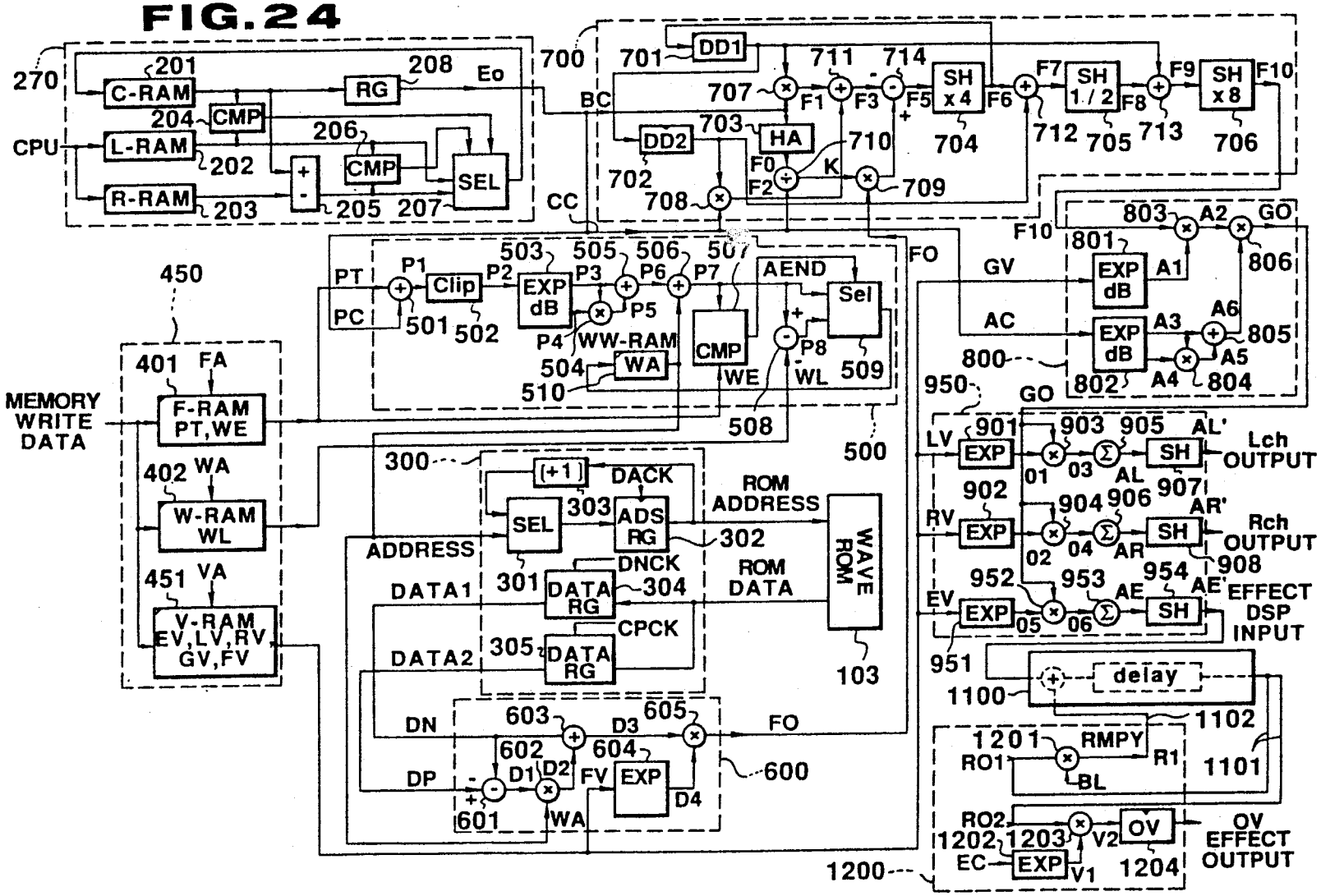
Figure 25:
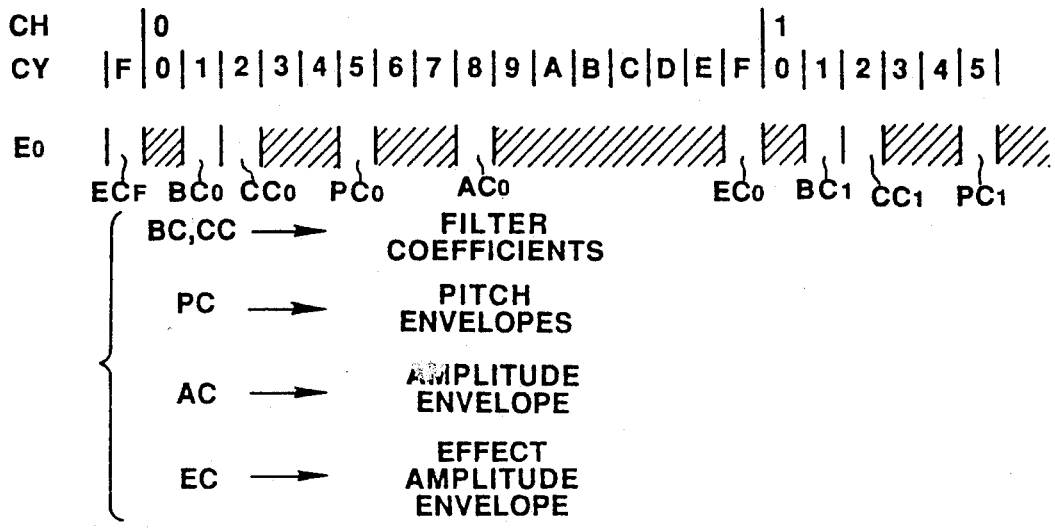
Figure 26:
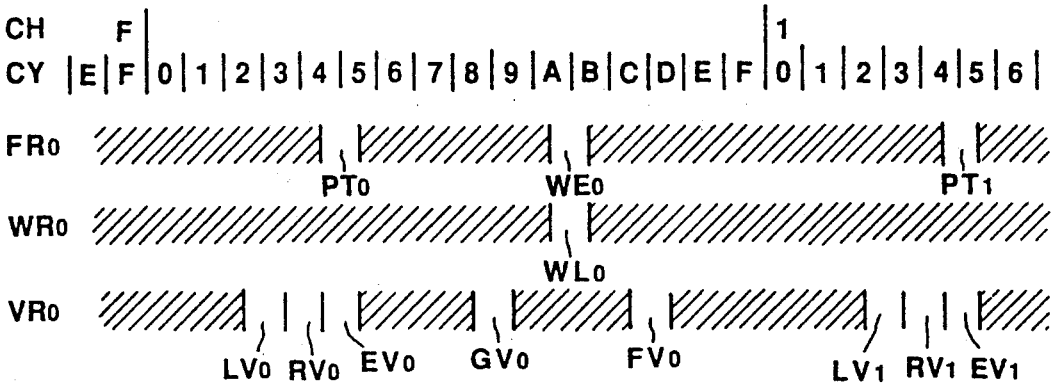

FIG. 24 is a functional block diagram of the overall operation of sound source device 150 and includes the following functional block components. In FIG. 24, sound source device 150 includes envelope generator 270 (corresponding to envelope generator 152 of FIG. 23) which delivers envelopes to the respective elements of the source device to be described later in more detail, musical sound data reader 300 which reads musical sound data from PCM-ROM (waveform ROM) 103, RAM block 450 (corresponding to RAM block 153 of FIG. 23) which stores predetermined RAM data including effect data, address counter 500, interpolator 600, digital filter 700, level control unit 800, output circuit 950 which provides left channel (Lch) and right channel (Rch) outputs due to accumulation, output circuit 950 which provides the right channel (Rch) output and effect DSP input, delay circuit 1100 which comprises effect DSP delay memory 154 and implemented by the effect DSP, and effect processor 1200 which generates an effect output sound using the effect DSP output, as shown in FIG. 25.

Envelope generator 270 is the same in structure as envelope generator 200 of FIG. 6 except that the former outputs effect amplitude envelope ECo used the effect amplification control in cycle F.

RAM block 450 is the same as RAM block 400 of FIG. 10 except that effect depth volume EV for outputting an effect is stored in V-RAM 451. Therefore, as the output timing chart for F-RAM 401, W-RAM 402, V-RAM 451 of RAM block 450 shown in FIG. 26, V-RAM 451 outputs Lch volume LVo, Rch volume RVo and, between cycles 4 and 5, effect depth volumes $EV_0$, $EV_1$.

Figure 30:
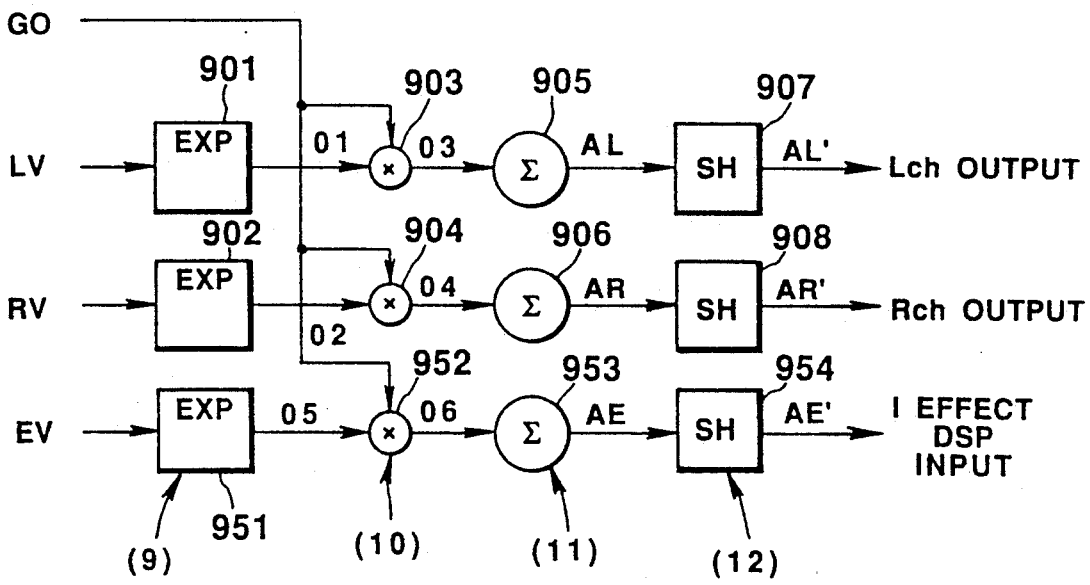

Output circuit 950 which is shown on enlarged scale in a block diagram of FIG. 30 includes exponent converters 901, 902, 951 which exponent convert Lch, Rch volumes and effect depth volume EV read from V-RAM 451 of RAM block 450, multipliers 903, 904, 952 which multiply exponent conversion values 01, 02, 05 by level control circuit 800 output Go, accumulators 905, 906, 953 which respectively accumulate outputs 03, 04, 06 from multipliers 903, 904, 952 to output accumulated data AL, AR, AE, and shift circuits 907, 908, 954 which output the final musical sound outputs AL', AR' and effect DSP input AE' shifted by respective quantities corresponding to the accumulation counts.

Figure 32:
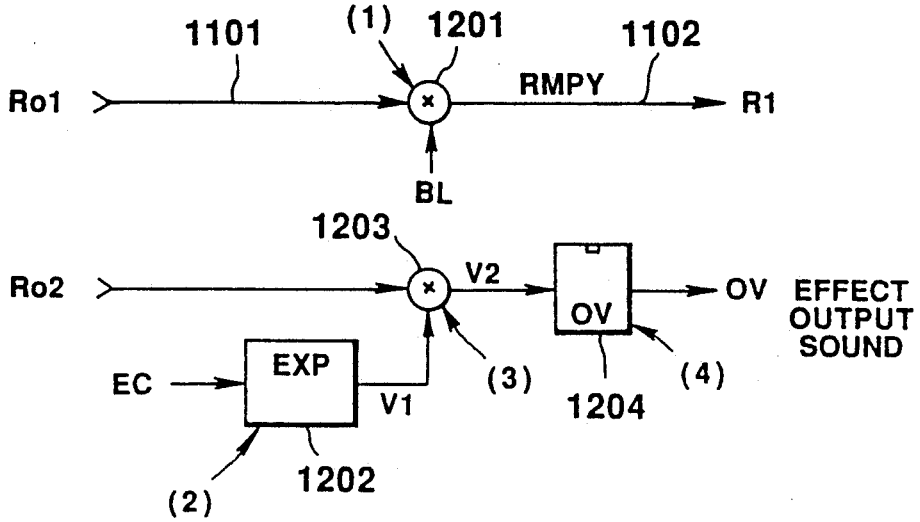

Effect processor 1200 which is shown on enlarged scale in a block diagram of FIG. 32 includes multiplier 120 which multiplies multiplicand received through RO bus 1201 by effect calculation parameter BL and returns the result through RI bus 1201, exponent converter 1202 which exponent converts effect envelope EC, multiplier 1203 which multiplies 16-time division effect output signal $E_{01}$ received through RO bus 1201 by effect envelope exponent conversion output V1 obtained from exponent converter 1202, and output register (OV) 1204 which latches output V2 from multiplier 1203 and outputs it as effect output sound OV.

Figure 27:
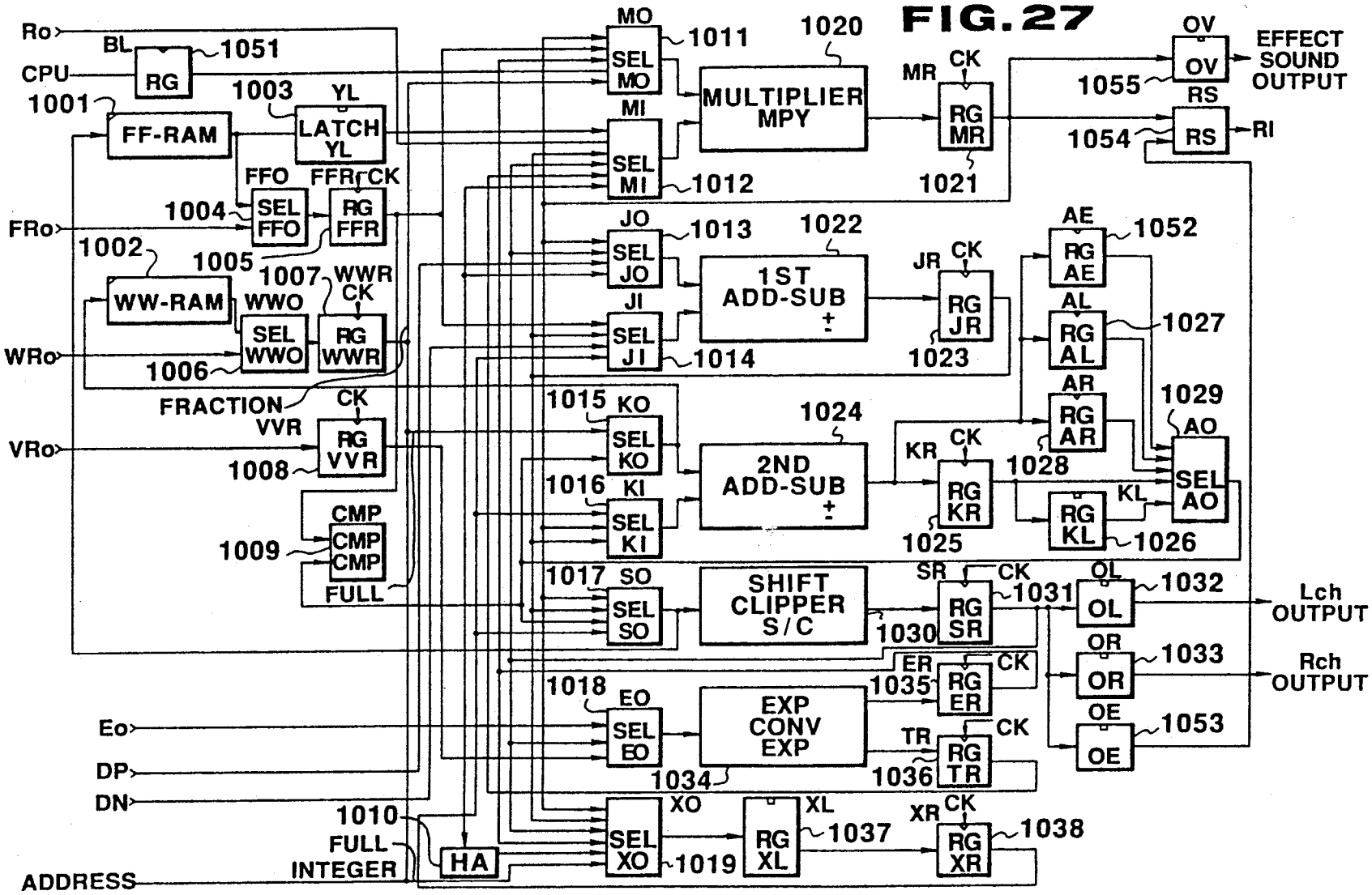

FIG. 27 shows the internal structure of DSP 151 and corresponds to that of DSP 101 of FIG. 4.

In FIG. 27, DSP 151 includes effect operation parameter register (BL) 1051 which latches effect operation parameter BL received from the CPU and provides the product for selector MR 1021, output register (AE) 1052 provided in parallel with second addition-subtraction output registers (AL) 1027 and (AR) 1028 to latch the result of the calculation by second subtracter 1024, register (OE) 1053 provided at the output side of shift clipper output register (SR) 1031 to latch the output from shift clipper output register (SR) 1031 and outputs it to data delivery selector (RS) 1054, data delivery selector (RS) 1054 provided on the output side of product output selector (MR) 1021 to select the outputs from product output selector (MR) 1021 and register (OE) 1053 and outputs it as data RI, and effect sound output register (OV) 1055 which latches the output from product output selector (MR) 1021 and outputs it as effect sound output OV.

Figure 28:
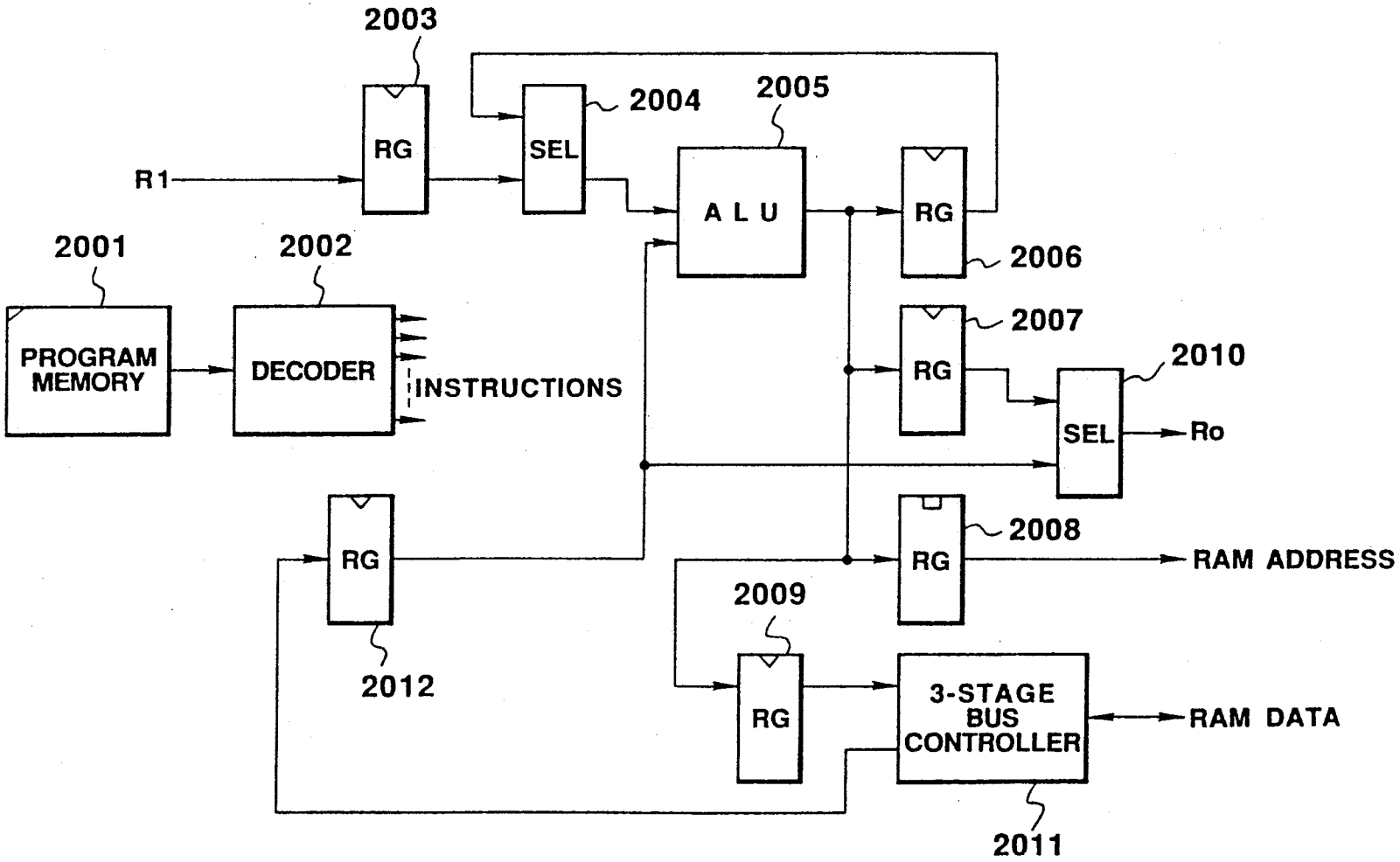

FIG. 28 shows the internal structure of effect DSP 155, which includes microprogram memory 2001 which stores predetermined microprograms for effect processing, microprogram decoder 2002 which decodes data read from microprogram memory 2001 and outputs it as a command to an ALU, registers to be described later in more detail, data input register 2003 to which output RI is input, ALU input selector 2004 which selects the outputs from data input register 2003 and ALU output register 2006 to be described in more detail later, ALU 2005 which performs a predetermined arithmetic operation in accordance with a command received from decoder 2002 on the basis of the outputs from ALU input selector 2004 and external RAM read data register 2012 to be described later in more detail, ALU output register 2006 which stores the result of the operation by ALU 2005, effect output register 2007, external RAM address register 2008, external RAM written data register 2009, effect DSP output selector 2010 which selects the outputs from effect output register 2007 and external RAM read data register 2012 and outputs it as data RO, 3-state bus controller 2011 which receives RAM data read from external RAM (not shown) using a RAM address from external RAM address register 2008 and receives data from RAM write data register 2009 and controls these data, and external RAM read data register 2012 which stores external RAM read data received through 3-state bus controller 2011 and outputs it to ALU 2005 and effect DSP output selector 2010.

The operation of this embodiment will be described below.

FIG. 29 is a timing chart indicative synthetically of the flow of signals in DSP 151 and corresponds to the timing chart of FIG. 5. The timing chart of FIG. 29 is differs from that of FIG. 5 in that predetermined data required for effect processing is stored in the respective registers concerned in cycles 0, 2, 5, 6, 7, 8 and F.

Figure 31:
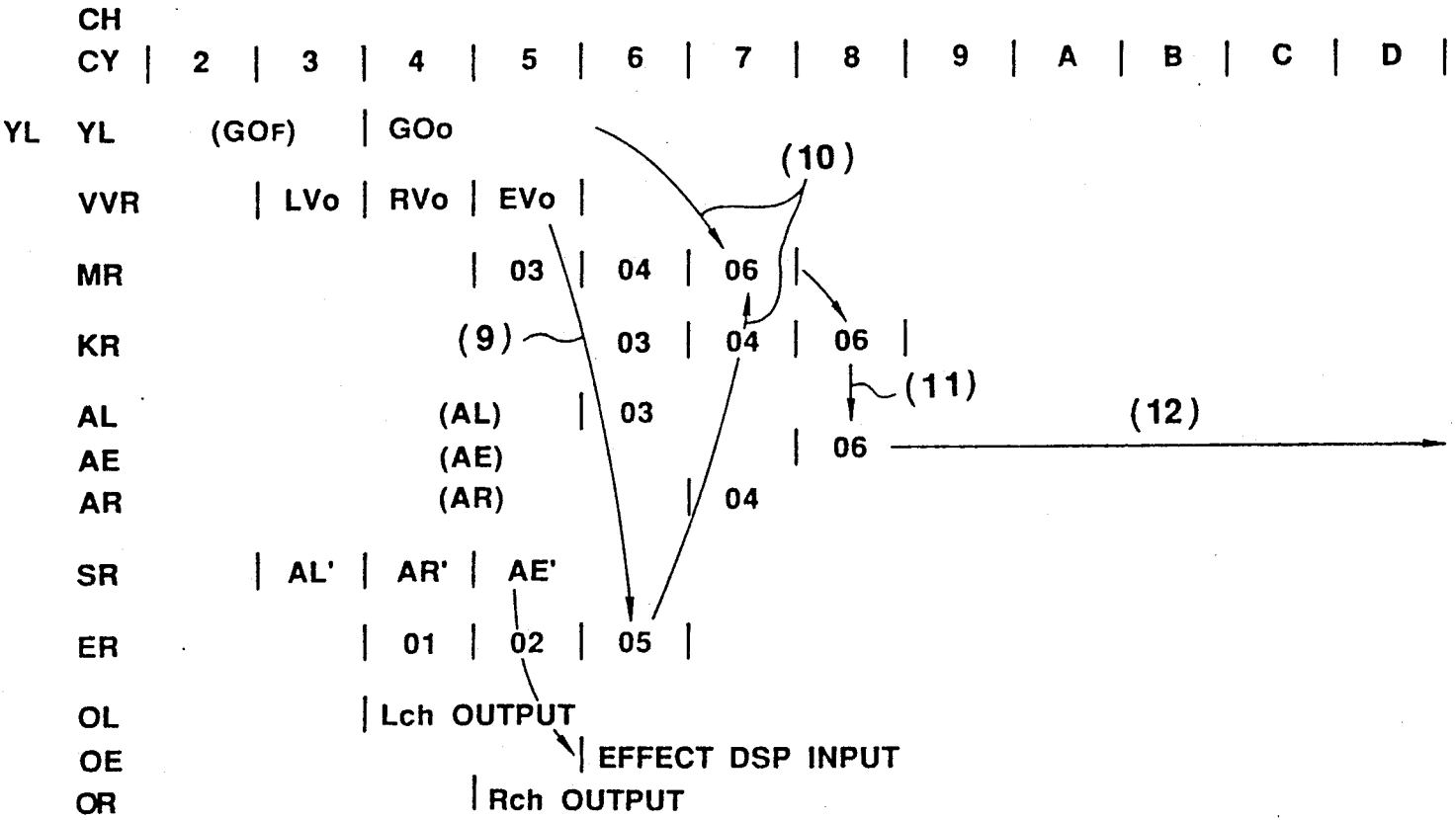

FIG. 30 is a block diagram of output circuit 950 of FIG. 24. FIG. 31 is a timing chart indicative of the operation of output circuit 950.

The timing chart of FIG. 31 corresponds to that of FIG. 2 and only added effect processing operations will be described using signs (9)–(12).

First, in cycle 5 effect depth volume EVo from V-RAM 451 is set in register (VVR) 1008 and the last effect output AE' is set in shift clipper output register (SR) 1031. In cycle 6 the last effect output AE' set in shift clipper output register (SR) 1031 is transferred to output register (OE) 1053 and outputs a effect DSP input. Effect depth volume EVo set in register (VVR) 1008 is exponent converted in exponent converter (EXP) 1034 to express EVo in decibel, and the resulting exponent conversion value 05 is set in exponent conversion output register (ER) 1035 (see (9)) In cycle 7 exponent conversion value 05 set in exponent conversion output register (ER) 1035 and output GO latched in output latch (YL) 1003 are multiplied and the resulting product output 06 is set in product output selector (MR) 1021 (see (10)). In cycle 8 product output 06 set in selector (MR) 1021 is transferred to second addition-subtraction output register (KR) 1025 and transferred also as accumulation output AE to output register (AE) 1052 (see (11)). Accumulation output AE is shifted by a quantity corresponding to the accumulation count in shift clipper (S/C) 1030 to become the final output AE' (see (12)). As just described above, by signal data processing of FIG. 31 on DSP 151 shown in FIG. 23, output circuit 950 of FIG. 3 is implemented to thereby allow effect DSP input to be provided.

Figure 33:
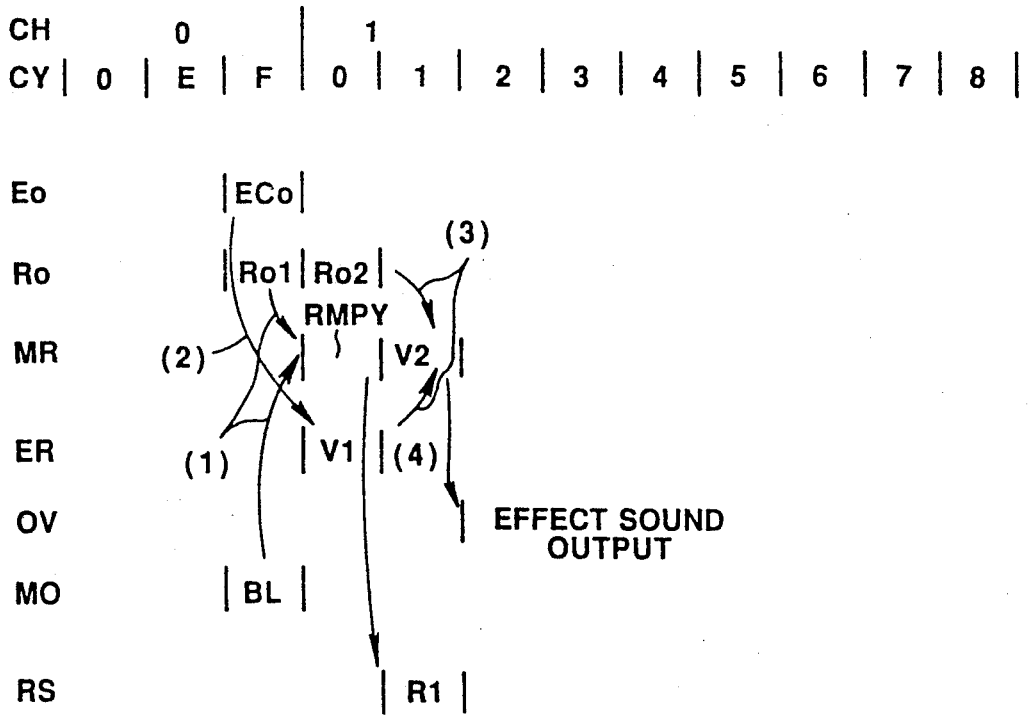

FIG. 32 is a block diagram of effect processor 1200 of FIG. 24. FIG. 33 is a timing chart indicative of the operation of effect processor 1200.

The timing chart of FIG. 33 is an extraction of from the overall timing chart of FIG. 29 directed to a selector (register) required for implementing effect processor 1200. The signs (1)–(4) in FIGS. 32 and 33 are used to describe the state of the operation and the flow of signal data.

First, in the final cycle F of sound generation channel 0, effect amplitude envelope ECo is set in exponent conversion input selector (EO) 1018, signal RO1 received through RO bus 1201 from delay circuit 1100 is read, and effect operation parameter BL is set in multiplication input selector (MO) 1011. Data RO1 read in cycle 0 of sound generation channel 1 is multiplied by effect operation parameter BL set in multiplication input selector (MO) 1011 and the resulting product value RMPY is set in product output selector (MR) 1021 (see (1)), effect amplitude envelope ECo set in exponent conversion input selector (EO) 1018 is exponent converted in exponent converter (EXP) 1034 to express ECo in decibel, and the resulting exponent conversion value V1 is set in exponent conversion output register (ER) 1035 (see (2)). In cycle 0 data R02 received through RO bus 1201 is read. Then, in cycle 1 product value RMPY set in multiplication output selector (MR) 1021 is transferred as output RI to shift clipper output register (SR) 1031, the read output signal R02 is multiplied by exponent conversion value Vl set in exponent conversion output register (ER) 1035, and the resulting product value V2 is set in product output selector (MR) 1021 (see (3)). In Cycle 2 product value V2 set in product output selector (MR) 1021 is set in output register (OV) 1055 (see (4)). In this way, in FIG. 32, multiplicand RO received through RO bus 1101 is multiplied by effect operation parameter BL in multiplier 1201 of DSP 151, the result is returned to effect DSP 155 through RI bus 1102. Similarly, 16-time division effect output signal R02 received through RO bus 1101 is multiplied by a exponent conversion of effect envelope EC in multiplier 1203 and output as an effect output sound from output register (OV) 1055.

As just described above, in the present embodiment, sound source device 150 includes effect DSP 155 and delay RAM 154 and performs effect processing by effect processor 1200 and effect outputting by output circuit 950 in parallel with other signal processing operations in a single cycle as shown in FIG. 28 as in the first embodiment. Therefore, the present embodiment serves the internal effect function in addition to those of the first embodiment, that is, a sound source device 150 having the improved function is provided.

While in the present embodiment the signal processor of the electronic musical instrument according to the present invention applied to a source sound device of the musical instrument is disclosed, the present invention is not limited to this. Of course, as long as a plurality of operations is performed successively in a single cycle, the present invention is applicable to all apparatus such as, for example, audio systems. The sound source device may be a PCM sound source or a sound source which generates predetermined waveforms using nonlinear synthetic operations, for example.

While in the present embodiment the sound source device having 16 sound generation channels is disclosed, the number of channels may be another one, of course.

The number and kinds of elements which compose DSPs 101, 151 and effect DSP 155 are not limited to those of the above embodiments. For example, the number of registers may be in creased, of course.

THIRD EMBODIMENT

FIGS. 34–41 show a third embodiment of a musical sound generator according to the present invention.

Figure 34:
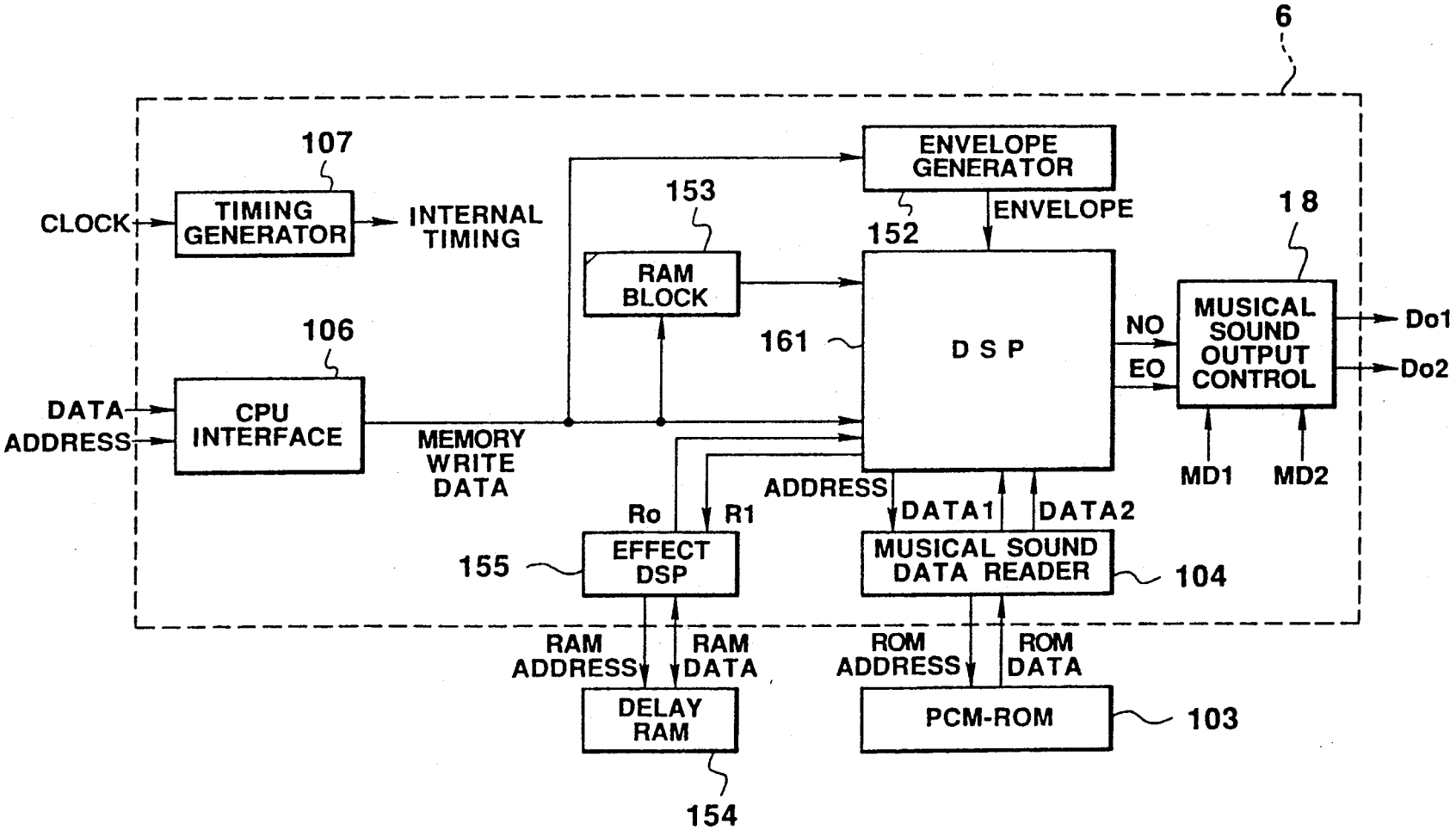

FIG. 34 is a block diagram indicative of the overall structure of sound source device 160 of the electronic musical instrument. In FIG. 34, sound source device 160 is made of a single LSI and includes DS (Digital Signal Processor) 161 which performs a centralized operation to generate a musical sound waveform, envelope generator 152, musical sound data reader 104, RAM block 153, CPU interface 106, timing generator 107, effect DSP 155 and musical sound output control unit 18 which changes data NO, EO output from DSP 161 to musical sound final output signals DD1, DD2 in accordance with external mode control signals MD1, MD2 and outputs those final output signals.

Figure 35:
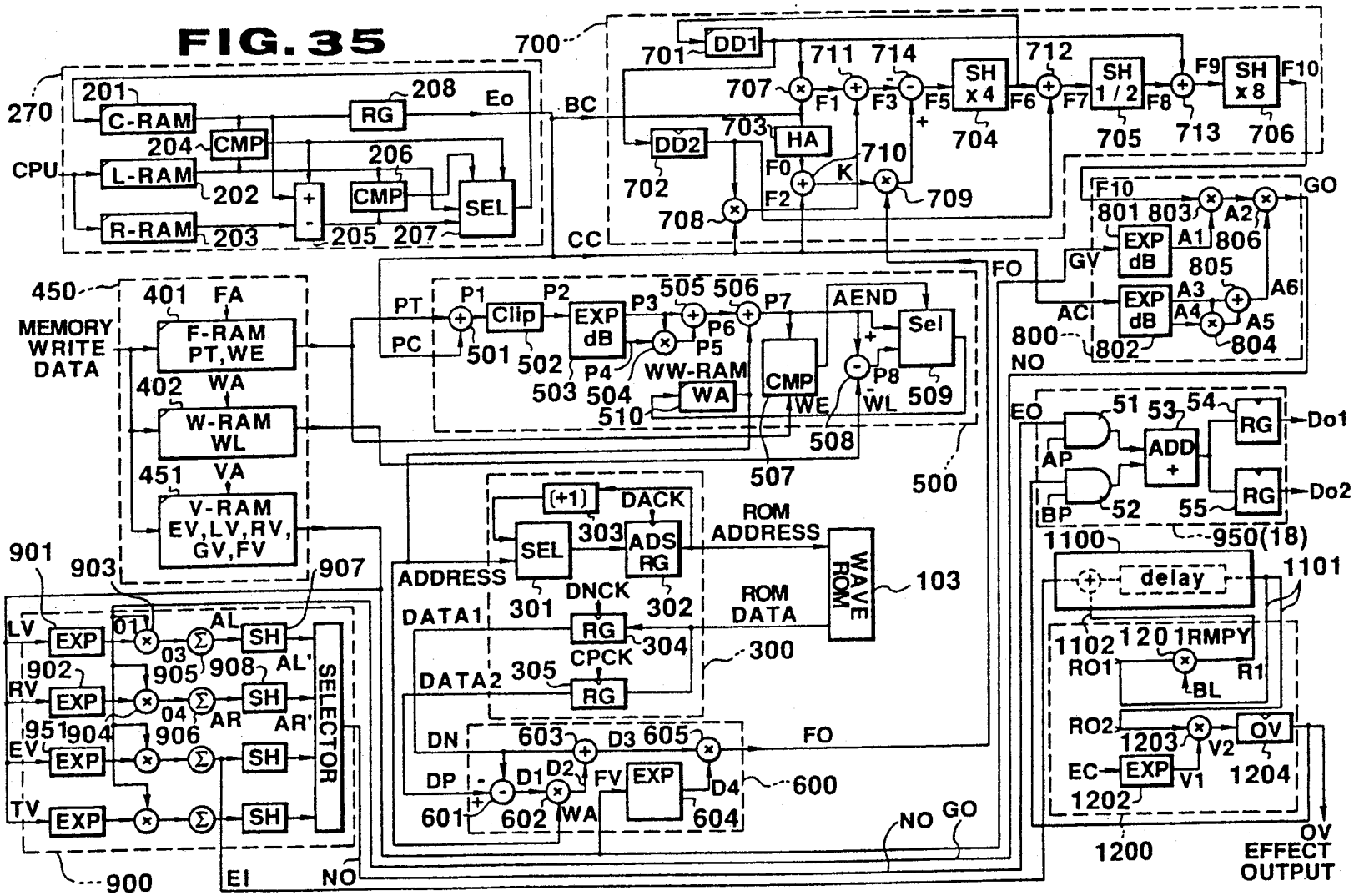

FIG. 35 is a functional block diagram indicative of the overall operation of sound source device 160 of the electronic musical instrument and includes the following functional block components. Like blocks in FIGS. 35 and 1 are identified by the same reference numeral and further description thereof will be omitted. Sound source device 160 of FIG. 35, is the same as the device of FIG. 24 except that the former additionally includes musical sound output control unit 950 (corresponding to musical sound output control unit 18 of FIG. 34) which receives outputs from output circuit 900 and effect processor 1200 and outputs sound signals DD1, DD2.

Figure 38:
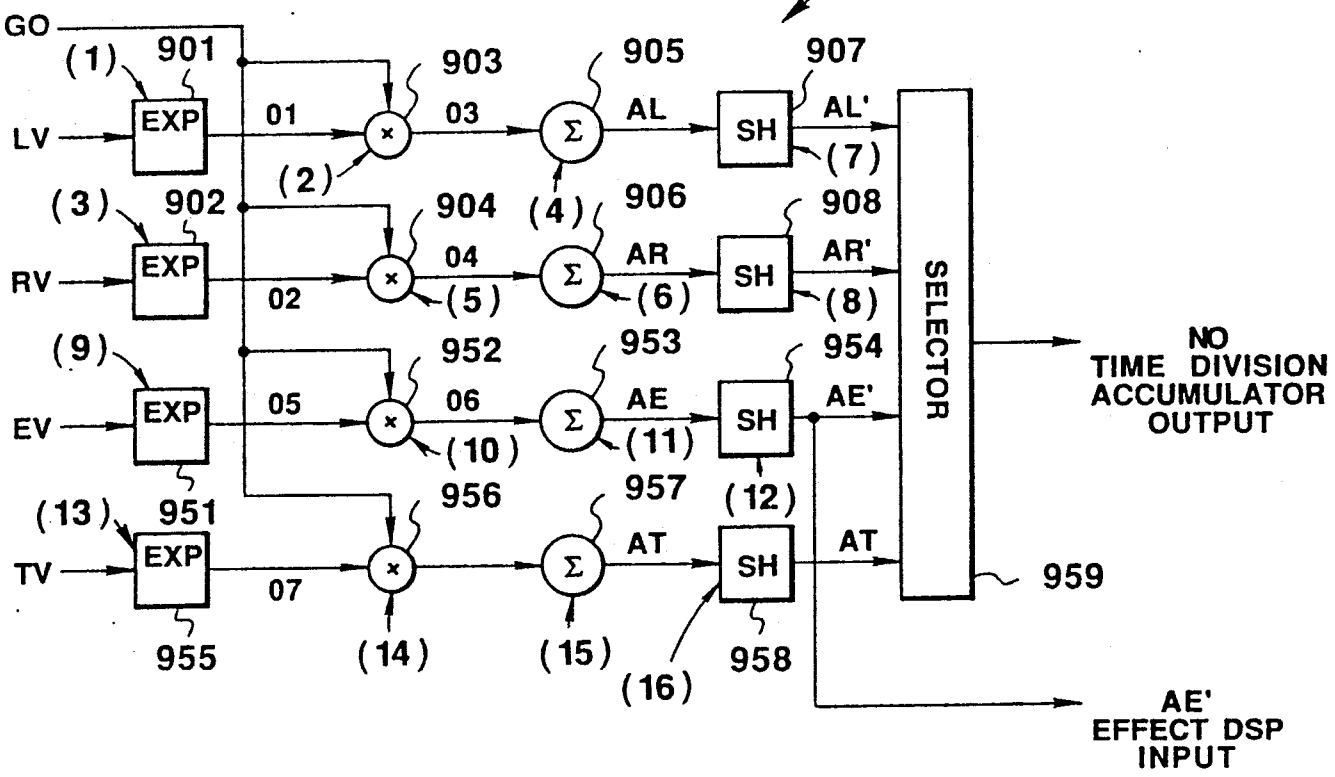

Output circuit 900 which is shown on enlarged scale in a block diagram of FIG. 38 includes exponent converters 901, 902, 951, 955 which exponent convert Lch volume LV, Rch volume RV, effect depth volume EV, chorus volume TV read from V-RAM 451 of RAM block 400; multipliers 903, 904, 952, 956 which multiply exponent conversion values 01, 02, 05, 07 by outputs Go from level control unit 800; accumulators 905, 906, 953, 957 which accumulate the outputs 03, 04, 06, 08 from multipliers 903, 904, 952, 956 individually and output them as accumulated data AL, AR, AE, AT;, shift circuits 907, 908, 954, 958 which shift by quantities corresponding to the accumulation counts and output as AL', AR', AE', AT'; and selector 959 which sequentially divides out puts AL', AR', AE', AT' at the timing of switching sound generation channels and outputs as NO in serial.

Figure 41:
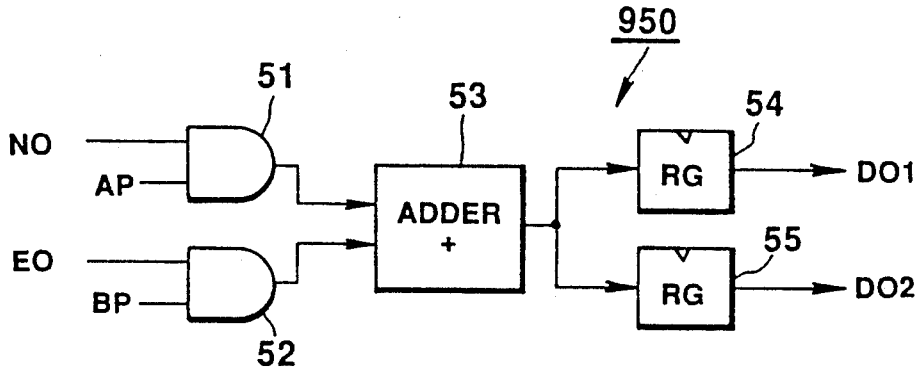

Musical sound output control unit 950 receives effect output OV and output NO from output circuit 900 and outputs the final musical sound outputs D10, D02, as shown in FIG. 41.

Figure 36:
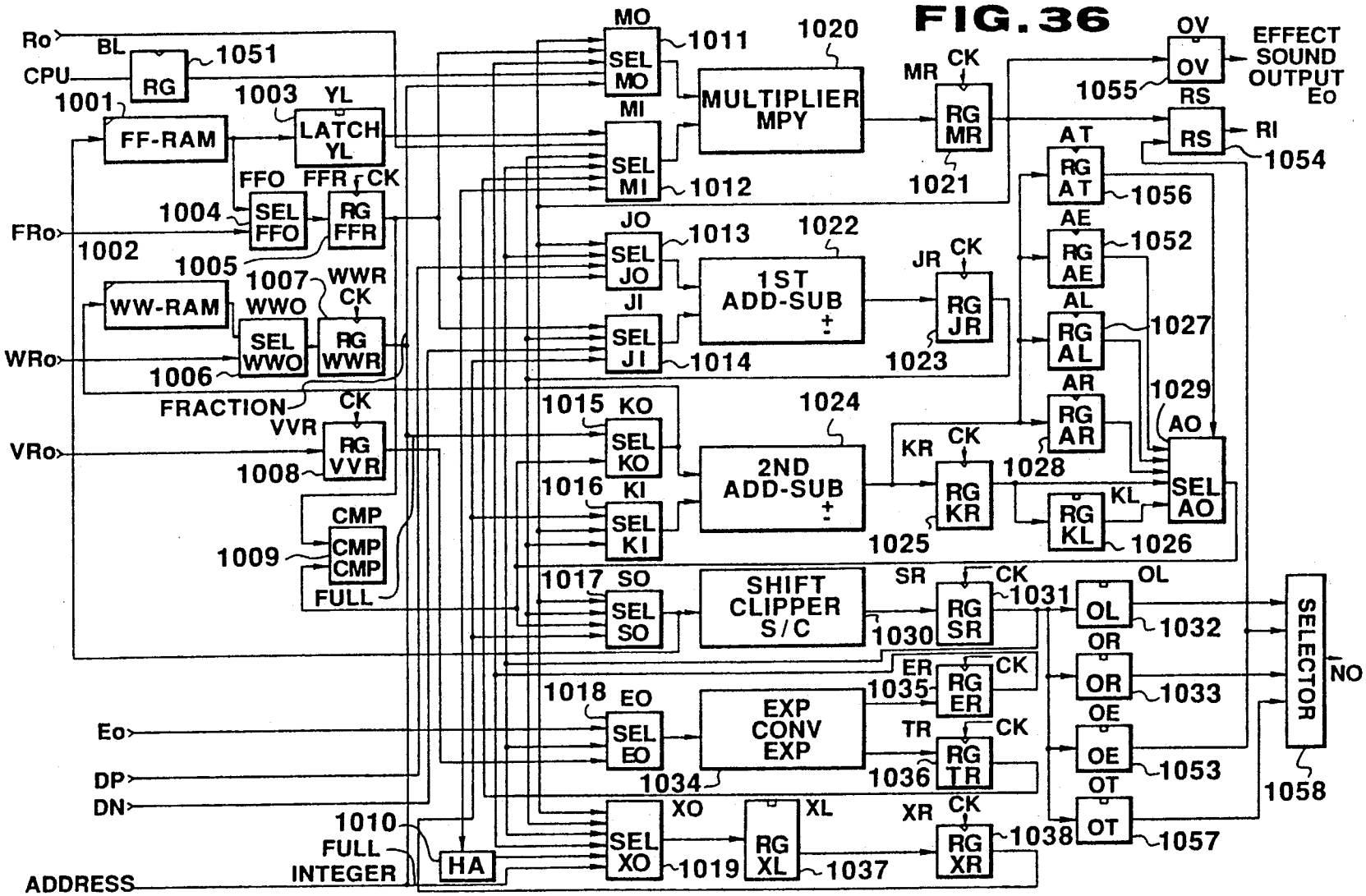

FIG. 36 shows the internal structure of DSP 151 which differs from DSP 151 of FIG. 27 in that the former includes register (AT) 1056 which latches the output from second adder-subtracter 1024 and provides the output for selector 1029, register (OT) 1057 which latches the output from register (OR) 1031, and selector 1058 which provides as an output NO the outputs from registers (OL) 1032, (OR) 1033, (OE) 1053 and (OT) 1057.

The operation of the third embodiment will be described below.

FIG. 37 is a timing chart synthetically indicative of the flow of signals in DSP 161.

First, FIG. 37 is a timing chart indicative of the flow of the signals in one sound generation channel CH (here, the first sound generation channel). This timing chart shows the flow of signal data read in operation cycle CY (here, of 16 cycles O–F) and stored in the respective selectors and registers concerned and is the same as FIG. 29 except that the former has signal data in second addition-subtraction input register KR.

Figure 39:
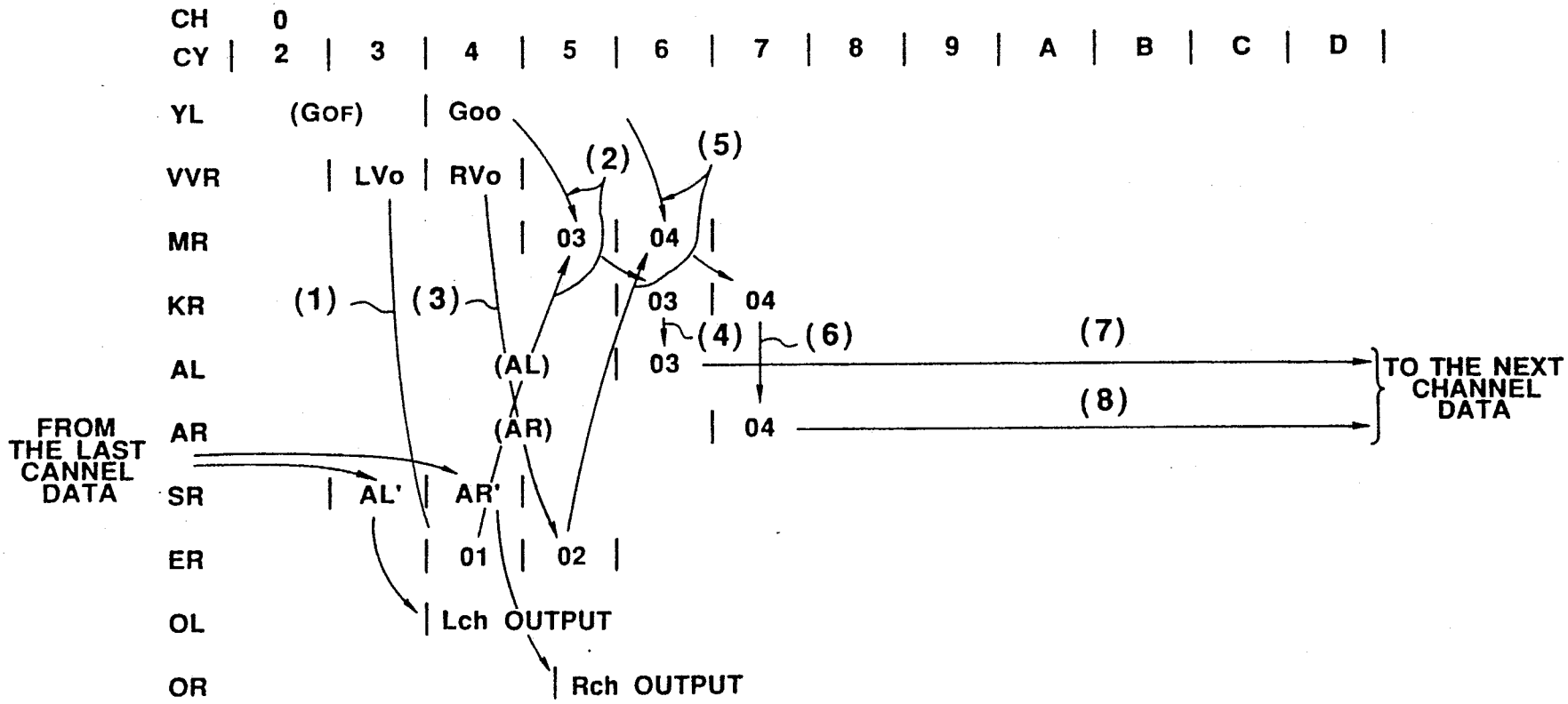
Figure 40:
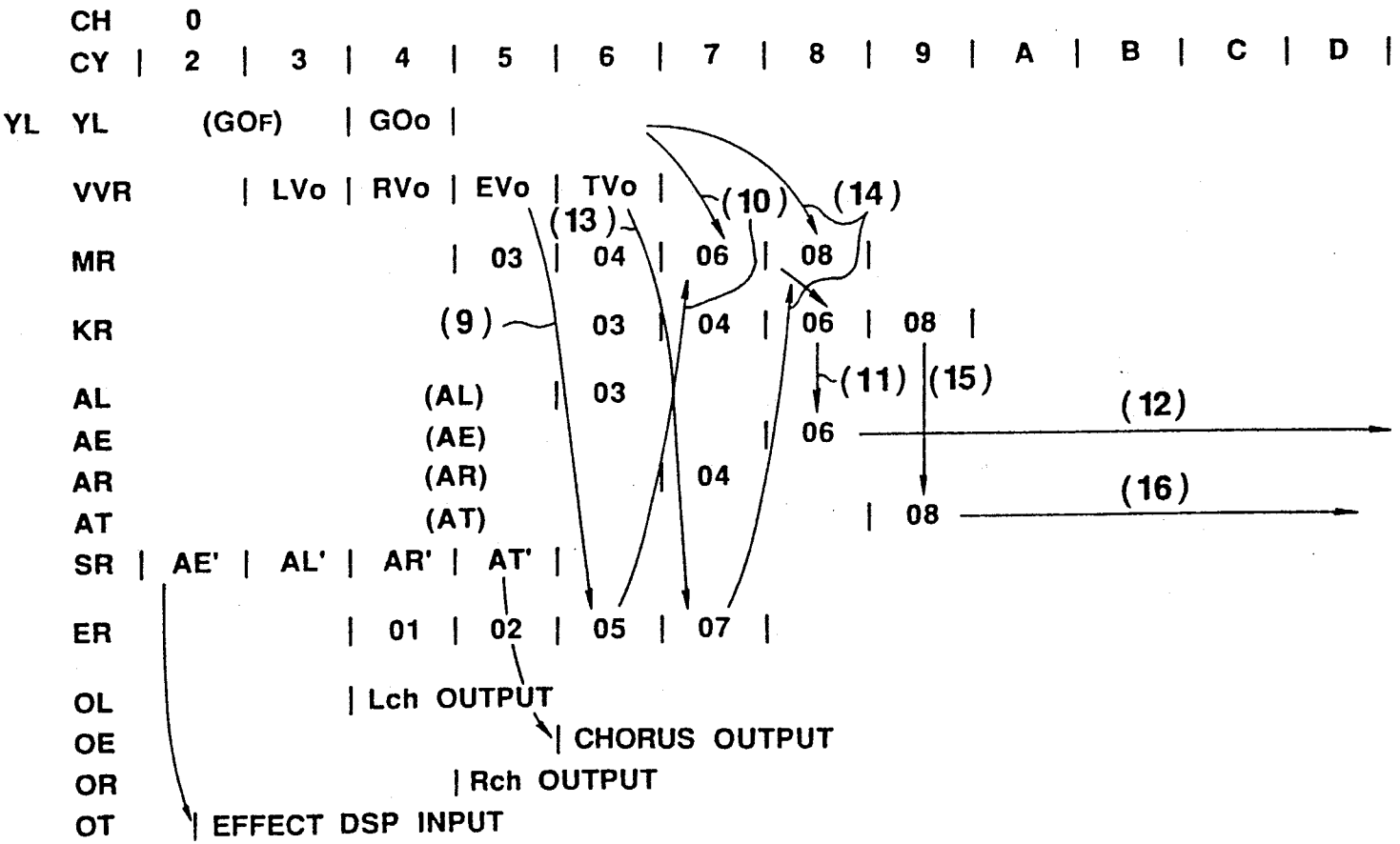

FIG. 38 is a block diagram of output circuit 900 of FIG. 35. FIGS. 39, 40 each are a timing chart indicative of the operation of output circuit 900.

The timing charts of FIGS. 39, 40 are extractions of the overall timing chart of FIG. 37 directed to a selector (register) required for implementing output circuit 900. The signs in (1)–(16) FIGS. 30–40 are used for explaining the state of operations and the flow of signal data.

First, up to cycle 3 the last output $G_{OF}$ of level control unit 800 is set in output latch (YL) 1003 of FF-RAM 1001. Left channel (Lch) volume LVo from V-RAM 451 is set in register (VVR) 1008 which latches the output from V-RAM 451 and the last left channel final output AL' is set in shift clipper output register (SR) 1031. In cycle 4 the current (sound generation channel #0) output $GO_0$ of level control unit 80 is set in output latch (YL) 1003, and left channel volume LVo set in register (VVR) 1008 is exponent converted in exponent converter (EXP) 1034 to express LVo in decibel and the resulting exponent conversion value 01 is set in exponent conversion output register (ER) 1035 (see (1)), and right channel (Rch) volume RVo from V-RAM 451 is set in register (VVR) 1008. In cycle 4 the last left channel final musical sound output AL' set in shift clipper output register (SR) 1031 is transferred to output register (OL) 1032 and output as a left channel output, and right channel (Rch) volume RVo from V-RAM 451 is set in shift clipper output register (SR) 1031. Next, in cycle 5 exponent conversion value 01 set in exponent conversion output register (ER) 1035 and output $GO_0$ latched in output latch (YL) 1003 are multiplied and the resulting product output 03 is set in product output selector (MR) 1021 (see (2)), right channel column RVo set in register (VVR) 1008 is exponent converted in exponent converter (EXP) 1034 to express RVo in decibel, and the resulting exponent conversion value 02 is set in exponent conversion output register (ER) 1035 (see (3)), and the last right channel final musical sound output AR' set in shift clipper output register (SR) 1031 is transferred to output register (OR) 1033 and provided as an output. Then in cycle 6 product output 03 set in selector (MR) 1021 is transferred to second addition-subtraction output register (KR) 1025 and transferred as accumulation output AL to output register (AL) 1027 (see (4)), and exponent conversion value 02 set in exponent conversion output register (ER) 1035 and output GOo latched in output latch (YL) 1003 are multiplied and the resulting product output 04 is set in product output selector (MR) 1021 (see (5)). In cycle 7 product output 04 set in selector (MR) 1021 is transferred to second addition-subtraction output register (KR) 1025 and also transferred as accumulation output AR to output register (AR) 1028 (see (6)). Accumulation outputs AL, AR are shifted by a quantity corresponding to the accumulation count in shift clipper (S/C) 1030 to become the final musical sound outputs AL', AR' (see (7), (8)). The accumulation is performed for every four channels of the channels #0–#F (Och–Fch), and when accumulations for the four channels is completed, reaccumulation is performed. As just described above, by signal data processing of FIG. 39 on DSP 151 shown in FIG. 11, output circuit 900 of FIG. 38 is capable of outputting a stereophonic output involving the left and right channels to selector 459.

The effect and chorus processing operations will be described using the signs (9)–(16) in the timing chart of FIG. 40.

First, the effect processing operation will be described. In cycle 5 effect depth volume EVo from V-RAM 451 is set in register (VVR) 1008, and the last effect output AE' is set in shift clipper output register (SR) 1031. In cycle 3 the last effect output AE' set in shift clipper output register (SR) 1031 is transferred to output register (OE) 1053 and outputs as effect DSP input. Effect depth volume EVo set in register (VVR) 1008 is exponent converted in exponent converter (EXP) 1034 to express EVo in decibel, and the resulting exponent conversion value 05 is set in exponent conversion output register (ER) 1035 (see (9)). In cycle 7 exponent conversion value 05 set in exponent conversion output register (ER) 1035 and output GOo latched in output latch (YL) 1003 are multiplied and the resulting product output 06 is set in product output selector (MR) 1021 (see (10)). In cycle 8 product output 06 set in selector (MR) 1021 is transferred to second addition-subtraction output register (KR) 1025 and transferred as accumulation output AE to output register (AE) 1052 (see (11)). Accumulation output AE is shifted by a quantity corresponding to the accumulation count in shift clipper (S/C) 1030 to become the final output AE' (see (12)). As just described, by signal data processing of FIG. 40 on DSP 161 shown in FIG. 36, output circuit 950 of FIG. 38 is capable of outputting effect DSP input data EI, which is input to selector 959 and also to effect DSP.

The chorus processing operation will be described below using the signs (13)–(16).

First, in cycle 6 chorus volume EVo from V-RAM 451 is set in register (VVR) 1008 and the last chorus output AT' is set in shift clipper output register (SR) 1031. In cycle 3 the last effect output AT' set in shift clipper output register (SR) 1031 is transferred to output register (OE) 1053 and supplied as a chorus output. Chorus volume TVo set in register (VVR) 1008 is exponent converted in exponent converter (EXP) 1034 to express TVo in decibel, and the resulting exponent conversion value 07 is set in exponent conversion output register (ER) 1035 (see (13)). In cycle 8 exponent conversion value 07 set in exponent conversion output register (ER) 1037 and output GOo latched in output latch (YL) 1003 are multiplied and the resulting product output 08 is set in product output selector (MR) 1021 (see (14)). In cycle 9 the product output is set in selector (MR) 1021.

Figure 42:
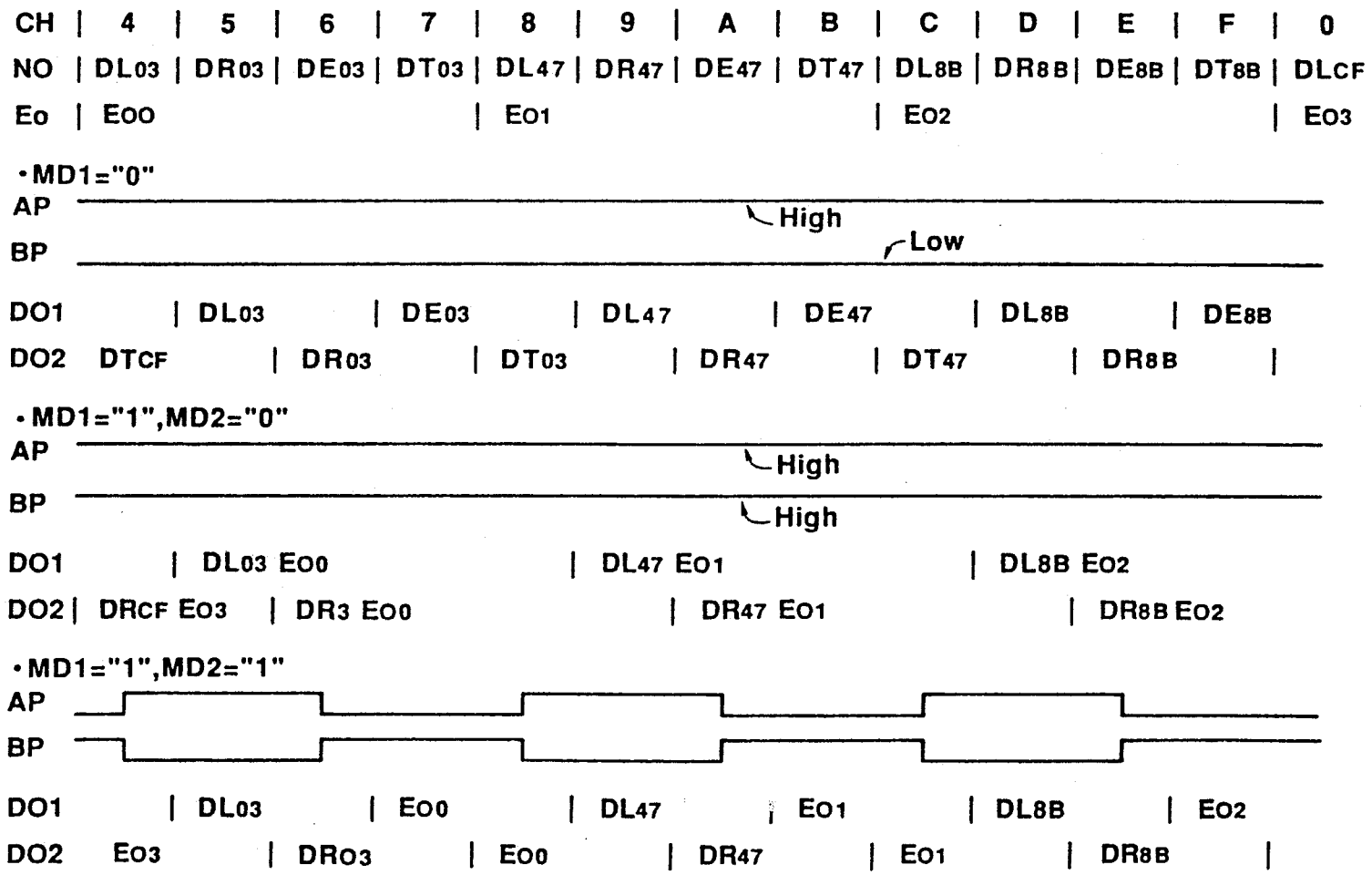

Output NO, thus generated, is input together output Eo from effect processor 1200 to musical sound output control unit 950, which outputs right and left channel outputs, an output for an effect input, chorus output or effect output separately or a mixture of these outputs in accordance with signals AP, BP which will become high or low in accordance with the state of mode control signals MD1, MD2 fed externally. FIG. 41 shows a part of the musical sound output control unit 950. FIG. 42 is a timing chart indicative of the operation of musical sound output control unit 950.

In FIG. 42, accumulation outputs $DL_{03}$, $DR_{03}$, $DE_{03}$, $DT_{03}$, ... are output through accumulator 900 on a 4-time division basis for every four sound generation channels from sound generation channel 4 to AND gate 51 of musical sound output control unit 950. Outputs $E_{00}$, $E_{01}$, ... are output from effect processor 1200 on a 4-time division basis for every four sound generation channels to AND gate 52. Signals AP, BP input to AND gates 51, 52 become high and low in accordance with mode control signals MD1, MD2 fed externally when MD=0; high when MD1=1 and MD2=0; become alternately high and low for every two sound generation channels when MD1 and MD2=1. Mode control signal MD1 shows that the internal effector is in use when MD1=1 and that it is not in use when MD1=0. Mode control signal MD2 becomes effective only when MD1=1 and shows an effect separation output when MD2=1, and a mixed output when MD2=0.

Therefore, when no internal effector is used, "high" AP and "low" BP are input to AND gates 51 and 52, respectively, by setting MD1 as MD1=0 to musical output control unit 950 to thereby provide four system accumulation outputs $DL_{03}$, $DR_{03}$, $DE_{03}$, $DT_{03}$ as outputs D01, D02 of musical sound output control unit 18 for every two sound generation channels without using effect DSP17.

When an effect mixture output is used, "high" AP, "high" BP are delivered to AND gates 51 and 52 by setting MD1, MD2 as MD1=1, MD2=0, respectively, to sound output control unit 8, L-system output $DL_{03}$ of accumulator 15 is mixed with output Eo from effect DSP 17 for every four sound generation channels such that output D01 provides output ($DC_{03}+E_{00}$) and output D02 provides output ($DR_{03}+E_{00}$).

When an effect is separated and output, AP, BP are alternately changed to "high", "low" for every two sound generation channels by setting MD1, MD2 as MD1=1, MD2=1, respectively, such that outputs D01 and D02 alternately provide separate accumulation and effect outputs $DC_{03}$, $DR_{03}$, $EP_{00}$, $E_{00}$, ..., as shown by D01, D02 in FIG. 42.

As described above, in the present embodiment, the final musical sound output control unit 950 has the function of selecting an output form, so that wide effect addition specifications are available and the musical sound generator is used as a sound source applicable to various articles. Since an effect depth (the depth implies an input volume independent of any channel) is set for each sound generation channel, control over effect addition for each sound generation is achieved on a real time basis on the basis of touch data, etc.

What is claimed is:

1. A musical sound generator comprising:

coefficient memory means for storing a plurality of coefficients to determine a characteristic of a musical sound;

a source of a synchronous timing signal; and a single signal processor including first operating means for performing, in a single cycle of said synchronous timing signal, a waveform data generating process which generates musical sound waveform data having a pitch frequency determined on the basis of a coefficient received for each cycle of said synchronous timing signal from said coefficient memory means, sound operating means for performing, in said single cycle of said synchronous timing signal, a filtering process which filters musical sound waveform data produced by the waveform data generating process performed in a cycle of said synchronous timing signal preceding a cycle in which the waveform data generating process is performed, and third operating means for performing, in said single cycle of said synchronous timing signal, an amplitude control process which controls the filtered musical sound waveform data so as to change the amplitude of a musical sound generated on the basis of the waveform data, and for outputting the resulting musical sound, and wherein the waveform data generating process is carried out overlapped in time with at least one of the filtering process and the amplitude control process.

2. A musical sound generator according to claim 1, wherein the filtering process and amplitude process are performed successively in a single cycle.

3. A musical sound generator according to claim 1, wherein the waveform data generating process comprises an accumulation process which accumulates address values at a pitch corresponding to a pitch frequency, and a waveform process for generating musical sound waveform data on the basis of the accumulated address values.

4. A musical sound generator according to claim 3, wherein the accumulation process and waveform process are performed in different cycles.

5. A musical sound generator according to claim 3, wherein the waveform process comprises reading musical sound waveform data on the basis of an accumulated address value, and interpolating the read musical sound waveform data on the basis of the accumulated address value.

6. A musical sound generator according to claim 1, further comprising envelope generating means for generating envelope data in response to an external signal, and wherein said signal processor includes means for controlling the value of musical sound waveform data produced by the waveform data generating process the filtering process and the amplitude process on the basis of the envelope data.

7. A musical sound generator according to claim 1, wherein said filtering process performs filtering of the musical sound waveform data on the basis of coefficients stored in said coefficient memory means.

8. A musical sound generator according to claim 8, wherein at least one of said operating means comprises multiplying means, and first and second addition-subtraction means.

9. A musical sound generator according to claim 8, wherein said multiplying means and said first addition-subtraction means perform the filtering process and amplitude process.

10. A musical sound generator according to claim 8, wherein said first operating means includes said multiplying means and said first and second addition-subtraction means, for performing the waveform data generating process.

11. A musical sound generator comprising:

coefficient memory means for storing a plurality of coefficients to determine a characteristic of a musical sound;

a source of a synchronous timing signal; and a single signal processor including:

first operating means for performing, in a single cycle of said synchronous timing signal, a waveform data generating process which generates musical sound waveform data having a pitch frequency determined on the basis of a coefficient received for each cycle of said synchronous timing signal from said coefficient memory means, second operating means for performing, in said single cycle of said synchronous timing signal, a filtering process which filters musical sound waveform data produced by the waveform data generating process previously performed in a cycle of said synchronous timing signal preceding a cycle in which the waveform data generating process is performed, third operating means for performing, in said single cycle of said synchronous timing signal, an amplitude control process which controls the filtered musical sound waveform data so as to change the amplitude of a musical sound generated on the basis of the waveform data, and for outputting the resulting musical sound, and fourth operating means for performing, in said single cycle of said synchronous timing signal, an output process for delivering musical sound waveform data from the amplitude control process previously performed in the cycle preceding the cycle in which the former amplitude control process is performed to a plurality of output terminals, and for multiplying the musical sound waveform data delivered to the plurality of output terminals by different coefficients from said coefficient memory means, and wherein the waveform data generating process is carried out overlapped in time with at least one of the filtering process and the amplitude control process at the plurality of output terminals.

12. A musical sound generator according to claim 11, wherein the filtering process and amplitude process are performed successively in a single cycle.

13. A musical sound generator according to claim 11, wherein the waveform data generating process comprises an accumulation process which accumulates address values at a pitch corresponding to a pitch frequency, and a waveform process for generating musical sound waveform data on the basis of the accumulated address values.

14. A musical sound generator according to claim 13, wherein the accumulation process and waveform process are performed in different cycles.

15. A musical sound generator according to claim 13, wherein the waveform process comprises reading musical sound waveform data on the basis of an accumulated address value, and interpolating the read musical sound waveform data on the basis of the accumulated address value.

16. A musical sound generator according to claim 11, further comprising envelope generating means for generating envelope data in response to an external signal, and wherein said signal processor includes means for controlling the value of musical sound waveform data produced by the waveform data generating process, the filtering process and the amplitude process on the basis of the envelope data.

17. A musical sound generator according to claim 11, wherein said filtering process performs filtering of the musical sound waveform data on the basis of coefficients stored in said coefficient memory means.

18. A musical sound generator according to claim 11, wherein at least one of said operating means comprises multiplying means, and first and second addition-subtraction means.

19. A musical sound generator according to claim 18, wherein said multiplying means and said first addition-subtraction means perform the filtering process and amplitude process.

20. A musical sound generator according to claim 19, wherein said first operating means includes said multiplying means and said first and second addition-subtraction means, for performing the waveform data generating process.

21. A musical sound generator comprising:

coefficient memory means for storing a plurality of coefficients to determine a characteristic of a musical sound;

a source of a synchronous timing signal; and a single signal processor including:

first operating means for performing, in a single cycle of said synchronous timing signal, a waveform data generating process which generates musical sound waveform data having a pitch frequency determined on the basis of a coefficient received for each cycle of said synchronous timing signal from said coefficient memory means, second operating means for performing, in aid single cycle of said synchronous timing signal, a filtering process which filters musical sound waveform data produced by the waveform data generating process previously performed in a cycle of said synchronous timing signal preceding a cycle in which the waveform data generating process is performed, third operating means for performing, in said single cycle of said synchronous timing signal, an amplitude control process which controls the filtered musical sound waveform data so as to change the amplitude of a musical sound generated on the basis of the waveform data, and for outputting the resulting musical sound, fourth operating means for performing, in said single cycle of said synchronous timing signal, an output process for delivering musical sound waveform data from the amplitude control process previously performed in the cycle preceding the cycle in which the former amplitude control process is performed to a plurality of output terminals, and for multiplying the musical sound waveform data delivered to the plurality of output terminals by different coefficients from said coefficient memory means at the plurality of output terminals, and fifth operating means for performing, in said single cycle of said synchronous timing signal, an effect process for imparting an effect to at least one of the musical sound waveform data from the amplitude control process performed in the cycle preceding the cycle in which the output process was performed, and wherein the waveform data generating process is carried out overlapped in time with at least one of the filtering process and the amplitude control process.

22. A musical sound generator according to claim 21, wherein the filtering process and amplitude process are performed successively in a single cycle.

23. A musical sound generator according to claim 21, wherein the waveform data generating process comprises an accumulation process which accumulates address values at a pitch corresponding to a pitch frequency, and a waveform process for generating musical sound waveform data on the basis of the accumulated address values.

24. A musical sound generator according to claim 23, wherein the accumulation process and waveform process are performed in different cycles.

25. A musical sound generator according to claim 23, wherein the waveform process comprises reading musical sound waveform data on the basis of an accumulated address value, and interpolating the read musical sound waveform data o the basis of the accumulated address value.

26. A musical sound generator according to claim 21, further comprising envelope generating means for generating envelope data in response to an external signal, and wherein said signal processor includes means for controlling the value of musical sound waveform data produced by the waveform data generating process, the filtering process and the amplitude process on the basis of the envelope data.

27. A musical sound generator according to claim 21, wherein said filtering process performs filtering of the musical sound waveform data on the basis of coefficients stored in said coefficient memory means.

28. A musical sound generator according to claim 21, wherein at least one of said operating means comprises multiplying means, and first and second addition-subtraction means.

29. A musical sound generator according to claim 28, wherein said multiplying means and said first addition-subtraction means perform the filtering process and amplitude process.

30. A musical sound generator according to claim 28, wherein said first operating means includes said multiplying means and said first and second addition-subtraction means, for performing the waveform data generating process.

31. A musical sound generator according to claim 28, wherein said multiplying means performs the effect process.

32. A musical sound generator comprising:

coefficient memory means for storing a plurality of coefficients to determine a characteristic of a musical sound;

a source of a synchronous timing signal; and a single signal processor including:

first operating means for performing, in a single cycle of said synchronous timing signal, a waveform data generating process which generates musical sound waveform data having a pitch frequency determined on the basis of a coefficient received for each cycle of said synchronous timing signal from said coefficient memory means, second operating means for performing in said single cycle of said synchronous timing signal, a filtering process which filters musical sound waveform data produced by the waveform data generating process previously performed in a cycle of said synchronous timing signal preceding a cycle in which the waveform data generating process is performed, third operating means for performing, in said single cycle of said synchronous timing signal, an amplitude control process which controls the filtered musical sound waveform data so as to change the amplitude of a musical sound generated on the basis of the waveform data, and for outputting the resulting musical sound, fourth operating means for performing, in said single cycle of said synchronous timing signal, an output process for delivering musical sound waveform data from the amplitude control process previously performed in the cycle preceding the cycle in which the former amplitude control process is performed to a plurality of output terminals, and for multiplying the musical sound waveform data delivered to the plurality of output terminals by different coefficients from said coefficient memory means at the plurality of output terminals, and fifth operating means for performing, in said single cycle of said synchronous timing signal, an effect process for imparting as effect to at least one of the musical sound waveform data from the amplitude control process performed in the cycle preceding the cycle in which the output process was performed, and wherein the waveform data generating process is carried out overlapped in time with at least one of the filtering process and the amplitude control process gate means for receiving the musical sound waveform data, which was subjected to the effect process, from said single signal processor, and for receiving the musical sound waveform data directly output from the output process, and for outputting at least one of both of the musical sound waveform data depending on an external operation; and mixing means for mixing musical sound waveform data from said gate means and for outputting the resulting mixed musical sound waveform data.

33. A musical sound generator according to claim 32, wherein the filtering process and amplitude process are performed successively in said single cycle.

34. A musical sound generator according to claim 32, wherein the waveform data generating process comprises an accumulation process which accumulates address values at a pitch corresponding to a pitch frequency, and a waveform process for generating musical sound waveform data on the basis of the accumulated address values.

35. A musical sound generator according to claim 34, wherein the accumulation process and waveform process are performed in different cycles.

36. A musical sound generator according to claim 34, wherein the waveform process comprises reading musical sound waveform data on the basis of an accumulated address value, and interpolating the read musical sound waveform data on the basis of the accumulated address value.

37. A musical sound generator according to claim 32, further comprising envelope generating means for generating envelope data in response to an external signal, and wherein said signal processor includes means for controlling the value of musical sound waveform data produced by the waveform data generating process the filtering process and the amplitude process on the basis of the envelope data.

38. A musical sound generator according to claim 32, wherein said filtering process performs filtering of the musical sound waveform data on the basis of coefficients stored in said coefficient memory means.

39. A musical sound generator according to claim 32, wherein at least one of said operating means comprises multiplying means, and first and second addition-subtraction means.

40. A musical sound generator according to claim 39, wherein said multiplying means and said first addition-subtraction means perform the filtering process and amplitude process.

41. A musical sound generator according to claim 39, wherein said first operating means includes said multiplying means and said first and second addition-subtraction means for performing the waveform data generating process.

42. A musical sound generator according to calm 39, wherein said multiplying means performs the effect process.

43. A musical sound generator comprising:

coefficient memory means for storing a plurality of coefficients to determine a characteristic of a musical sound;

a source of a synchronous timing signal; and a single signal processor including:

first operating means for performing, in a single cycle of said synchronous timing signal, a waveform data generating process which generates musical sound waveform data having a pitch frequency determined on the basis of a coefficient received for each cycle of said synchronous timing signal from said coefficient memory means, and second operating means for performing, in said single cycle of said predetermined synchronous signal, a filtering process which filters musical sound waveform data produced by the waveform data generating process previously performed in a cycle of said synchronous timing signal preceding a cycle of said synchronous timing signal in which the waveform data generating process is performed, and for outputting the resulting musical sound, and wherein the filtering process is carried out overlapped in time with the waveform data generating process.

44. A musical sound generator according to claim 43, wherein the waveform data generating process comprises an accumulation process which accumulates address values at a pitch corresponding to a pitch frequency data, and a waveform process for generating musical sound waveform data on the basis of the accumulated address values.

45. A musical sound generator according to claim 44, wherein the accumulation process and waveform process are performed in different cycles.

46. A musical sound generator according to claim 44, wherein the waveform process comprises reading musical sound waveform data on the basis of an accumulated address value, and interpolating the read musical sound waveform data on the basis of the accumulated address value.

47. A musical sound generator according to claim 43, further comprising envelope generating means for generating envelope data in response to an external signal, and wherein said signal processor includes means for controlling the value of musical sound waveform data produced by the waveform data generating process and the filtering process on the basis of the envelope data.

48. A musical sound generator according to claim 43, wherein said signal filtering process performs filtering of the musical sound waveform data on the basis of coefficients stored in said coefficient memory means.

49. A musical sound generator according to claim 48, wherein at least one of said plurality of operating means comprises multiplying means, and first and second addition-subtraction means.

50. A musical sound generator according to claim 49, wherein said multiplying means and said first addition-subtraction means perform the filtering process.

51. A musical sound generator according to claim 49, wherein said first operating means includes said multiplying means and said first and second addition-subtraction means for performing the waveform data generating process.

* * * * *

UNITED STATES PATENT AND TRADEMARK OFFICE

CERTIFICATE OF CORRECTION

PATENT NO. :5,283,387

DATED :February 1, 1994

INVENTOR(S) :TANAKA, Kikuji

It is certified that error appears in the above-identified patent and that said Letters Patent is hereby corrected as shown below:

Title page:

Section [30] "Foreign Application Priority Data"

delete, "Nov. 20, 1990 [JP] Japan...2-315245" (first occurrence)

Section [56] References Cited, "U.S. PATENT DOCUMENTS"

after "4,554,857", change "11/1987 to --11/1985--.

"4,677,789" should be --4,677,890--

Column 28, line 5 (claim 20), "to claim 19" should be --to claim 18--.

Column 28, line 24 (claim 21), "aid" should be --said--.

Column 30, line 17 (claim 32) "as" should be --an--.

Signed and Sealed this

Twelfth Day of September, 1995

*Attest:*

*Attesting Officer*

BRUCE LEHMAN

*Commissioner of Patents and Trademarks*